US011428373B2

(12) United States Patent
Bernard et al.

(10) Patent No.: US 11,428,373 B2
(45) Date of Patent: Aug. 30, 2022

(54) EDGE LIT FIXTURE

(71) Applicant: IDEAL INDUSTRIES LIGHTING LLC, Racine, WI (US)

(72) Inventors: Randy Bernard, Cary, NC (US); Nathan Snell, Raleigh, NC (US); James Michael Lay, Apex, NC (US); S. Scott Pratt, Cary, NC (US)

(73) Assignee: IDEAL INDUSTRIES LIGHTING LLC, Racine, WI (US)

( * ) Notice: Subject to any disclaimer, the term of this patent is extended or adjusted under 35 U.S.C. 154(b) by 90 days.

(21) Appl. No.: 15/930,015

(22) Filed: May 12, 2020

(65) Prior Publication Data

US 2020/0271290 A1 Aug. 27, 2020

Related U.S. Application Data

(62) Division of application No. 14/622,821, filed on Feb. 13, 2015, now Pat. No. 10,690,305, which is a (Continued)

(51) Int. Cl.
*F21S 8/02* (2006.01)
*F21V 33/00* (2006.01)

(Continued)

(52) U.S. Cl.
CPC ..... *F21S 8/026* (2013.01); *F21K 9/27* (2016.08); *F21S 4/20* (2016.01); *F21S 4/28* (2016.01);

(Continued)

(58) Field of Classification Search
CPC ..... F21Y 2115/10
See application file for complete search history.

(56) References Cited

U.S. PATENT DOCUMENTS 3,113,728 A * 12/1963 Boyd ..... F21V 7/0016 52/28
4,175,281 A 11/1979 Lonseth (Continued)

FOREIGN PATENT DOCUMENTS

| | | | | |
|---|---|---|---|---|
| DE | 102012006887 | | 10/2012 | |
| EP | 2650599 | | 10/2013 | |
| WO | WO 2014126501 | * | 8/2014 | ..... F21S 8/00 |

OTHER PUBLICATIONS

Notice of Allowance for U.S. Appl. No. 14/526,368, dated Apr. 19, 2021, 10 pages.

(Continued)

*Primary Examiner* — Zheng Song
(74) *Attorney, Agent, or Firm* — J. Clinton Wimbish; Nexsen Pruet, PLLC

(57) ABSTRACT

An edge lit fixture. A light engine comprises a compartment and at least one elongated lens that are attachable to a mount plate. The mount plate, an exterior surface of the compartment, and the lens define an internal optical cavity. A light strip is mounted to the mount plate within the optical cavity. One or more legs can be used to attach the fixture to an external surface, such as a ceiling T-grid. The light engine can be used with legs of varying size such that it can fit within ceiling openings having different dimensions. The assembled fixture defines an open area. One or more light engines are arranged around or through the open area such that light is emitted into the open area. The open area of the fixture allows for existing materials, such as a ceiling tile, for example, to function as a back side reflector panel.

16 Claims, 15 Drawing Sheets

Related U.S. Application Data division of application No. 14/526,368, filed on Oct. 28, 2014, now Pat. No. 11,079,076.

(51) Int. Cl.

| | |
|---|---|
| ***F21V 17/00*** | (2006.01) |
| ***F21V 21/04*** | (2006.01) |
| ***F21S 4/28*** | (2016.01) |
| ***F21V 7/00*** | (2006.01) |
| ***F21K 9/27*** | (2016.01) |
| ***F21S 4/20*** | (2016.01) |
| *F21Y 115/10* | (2016.01) |
| *F21Y 103/10* | (2016.01) |

(52) U.S. Cl.

CPC ..... *F21V 7/0008* (2013.01); *F21V 17/007* (2013.01); *F21V 21/049* (2013.01); *F21V 33/006* (2013.01); *F21Y 2103/10* (2016.08); *F21Y 2115/10* (2016.08)

(56) References Cited

U.S. PATENT DOCUMENTS

| | | | | |
|---|---|---|---|---|
| 4,933,820 | A * | 6/1990 | Engel | F21V 7/0016 362/217.05 |
| 5,823,663 | A | 10/1998 | Bell et al. | |
| 6,079,851 | A * | 6/2000 | Altman | F21S 8/02 362/217.05 |
| 6,179,451 | B1 | 1/2001 | Bodine et al. | |
| 6,210,025 | B1 | 4/2001 | Schmidt et al. | |
| 6,945,668 | B1 | 9/2005 | Orlov et al. | |
| 7,213,940 | B1 | 5/2007 | Van De Ven et al. | |
| 7,506,994 | B1 | 3/2009 | Waycaster et al. | |
| 7,768,192 | B2 | 8/2010 | Van De Ven et al. | |
| 7,954,975 | B2 * | 6/2011 | Zhou | F21S 8/026 362/147 |
| 8,083,369 | B1 * | 12/2011 | Richardson | F21V 17/107 362/365 |
| 8,096,671 | B1 | 1/2012 | Cronk et al. | |
| 8,523,388 | B2 * | 9/2013 | Wu | F21V 7/0016 362/240 |
| 9,062,838 | B1 | 6/2015 | Merrill, Jr. | |
| 2003/0210546 | A1 | 11/2003 | Chin | |
| 2006/0198127 | A1 * | 9/2006 | Lippis | F21S 8/06 362/147 |
| 2006/0262521 | A1 | 11/2006 | Piepgras et al. | |
| 2010/0135020 | A1 | 6/2010 | Moore | |
| 2010/0246176 | A1 | 9/2010 | Shyu et al. | |
| 2011/0043132 | A1 | 2/2011 | Kim et al. | |
| 2011/0219718 | A1 | 9/2011 | Gerkes et al. | |
| 2012/0162982 | A1 | 6/2012 | Wang et al. | |
| 2012/0236537 | A1 | 9/2012 | Pickard | |
| 2012/0236597 | A1 | 9/2012 | Liao et al. | |
| 2012/0250301 | A1 | 10/2012 | Tung et al. | |
| 2013/0027915 | A1 * | 1/2013 | Caferro | F21V 29/507 362/147 |
| 2013/0063948 | A1 | 3/2013 | Ishii | |
| 2013/0107518 | A1 | 5/2013 | Boyer et al. | |
| 2013/0107527 | A1 | 5/2013 | Boyer et al. | |
| 2013/0250567 | A1 | 9/2013 | Edmond et al. | |
| 2013/0286637 | A1 * | 10/2013 | Lay | F21V 7/0008 362/147 |
| 2013/0294053 | A1 | 11/2013 | Marquardt et al. | |
| 2013/0335962 | A1 | 12/2013 | Wu et al. | |
| 2014/0036503 | A1 * | 2/2014 | Olsen | F21V 21/048 362/249.02 |
| 2014/0167065 | A1 | 6/2014 | Bergmann et al. | |
| 2014/0168065 | A1 | 6/2014 | Huang et al. | |
| 2014/0233228 | A1 | 8/2014 | Komiyama et al. | |
| 2014/0268721 | A1 | 9/2014 | Durkee et al. | |
| 2015/0233533 | A1 | 8/2015 | Van Es | |
| 2015/0276125 | A1 * | 10/2015 | Pratt | F16M 13/022 362/217.15 |
| 2016/0102825 | A1 * | 4/2016 | Scribante | F21V 23/002 362/217.14 |
| 2016/0369972 | A1 | 12/2016 | Thijssen et al. | |

OTHER PUBLICATIONS

Examination Report for German Patent Application No. 112015004502.3, dated May 25, 2018, 12 pages.
Examination Report for German Patent Application No. 112015004502.3, dated Feb. 10, 2021, 9 pages.
Non-Final Office Action for U.S. Appl. No. 14/526,368, dated Jul. 28, 2016, 16 pages.
Final Office Action for U.S. Appl. No. 14/526,368, dated Feb. 2, 2017, 20 pages.
Non-Final Office Action for U.S. Appl. No. 14/526,368, dated Feb. 8, 2019, 18 pages.
Final Office Action for U.S. Appl. No. 14/526,368, dated Nov. 13, 2019, 20 pages.
Advisory Action for U.S. Appl. No. 14/526,368, dated Feb. 4, 2020, 3 pages.
Non-Final Office Action for U.S. Appl. No. 14/526,368, dated May 5, 2020, 8 pages.
Final Office Action for U.S. Appl. No. 14/526,368, dated Sep. 15, 2020, 11 pages.
Applicant-Initiated Interview Summary for U.S. Appl. No. 14/526,368, dated Nov. 3, 2020, 4 pages.
Non-Final Office Action for U.S. Appl. No. 14/526,368, dated Dec. 10, 2020, 10 pages.
Final Office Action for U.S. Appl. No. 14/622,821, dated Nov. 8, 2017, 23 pages.
Non-Final Office Action for U.S. Appl. No. 14/622,821, dated May 19, 2017, 22 pages.
Non-Final Office Action for U.S. Appl. No. 14/622,821, dated Jan. 3, 2019, 23 pages.
Final Office Action for U.S. Appl. No. 14/622,821, dated Jul. 22, 2019, 24 pages.
Advisory Action for U.S. Appl. No. 14/622,821, dated Dec. 12, 2019, 3 pages.
Notice of Allowance for U.S. Appl. No. 14/622,821, dated Feb. 21, 2020, 8 pages.
International Search Report and Written Opinion from European Patent App. No. PCT/US2015/057649, dated Dec. 17, 2015.
International Preliminary Report for International Application No. PCT/US2015/057649, dated May 11, 2017.
Office action for U.S. Appl. No. 14/526,368; dated Sep. 8, 2017.
Office Action for U.S. Appl. No. 14/526,368, dated Mar. 2, 2018.
Cree LMR4 LED Module with TruoWhite Technology, Product Family Data Sheet. CLM-DS01 LMR4 Rev. 6A Copyright 2011-2014 Cree, Inc., 4600 Silicon Dr., Durham NC 27703 www.cree.com.
Cree XLamp MP-L EasyWhite LEDw, Product Family Data Sheet. Copyright 2010-2015 Cree, Inc., 4600 Silicon Dr., Durham NC 27703. www.cree.com.
U.S. Appl. No. 12/873,303, filed Aug. 31, 2010 to Edmond et al.
U.S. Appl. No. 13/464,745, filed May 4, 2012 to Pratt et al.
U.S. Appl. No. 13/442,311, filed Apr. 9, 2012, to Lu et al.
U.S. Appl. No. 13/168,689, filed Jun. 24, 2011 to Bergmann et al.
U.S. Appl. No. 14/526,368, filed Oct. 28, 2014 to Bernard et al.

* cited by examiner

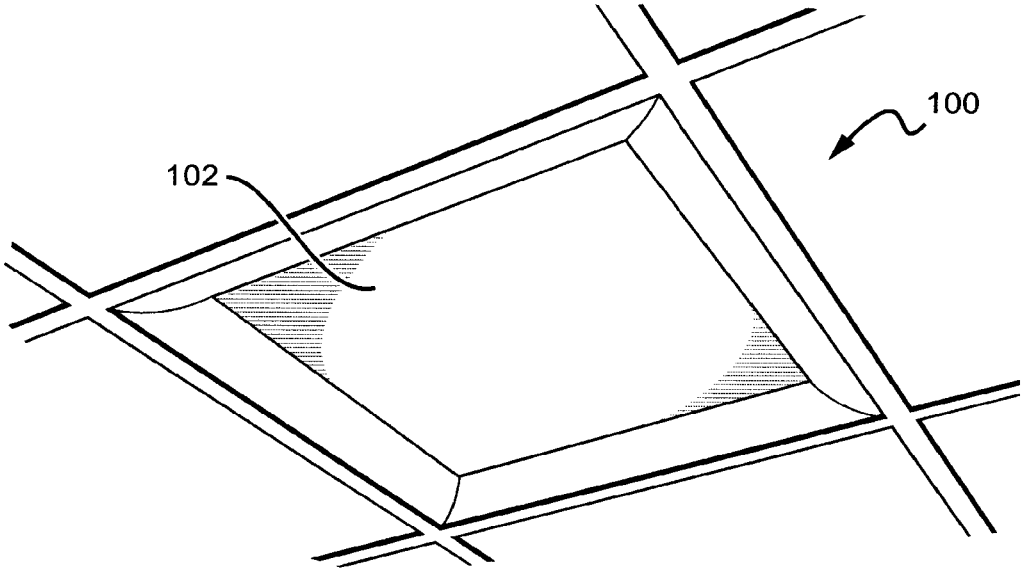
FIG. 1
FIG. 2
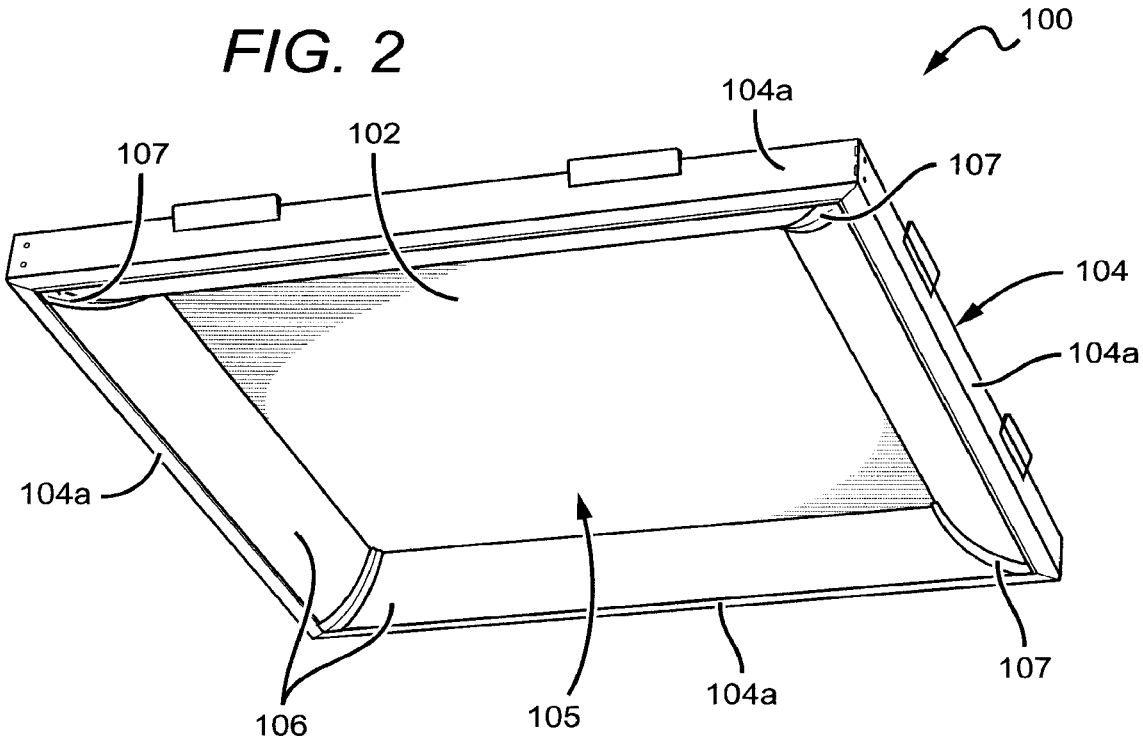

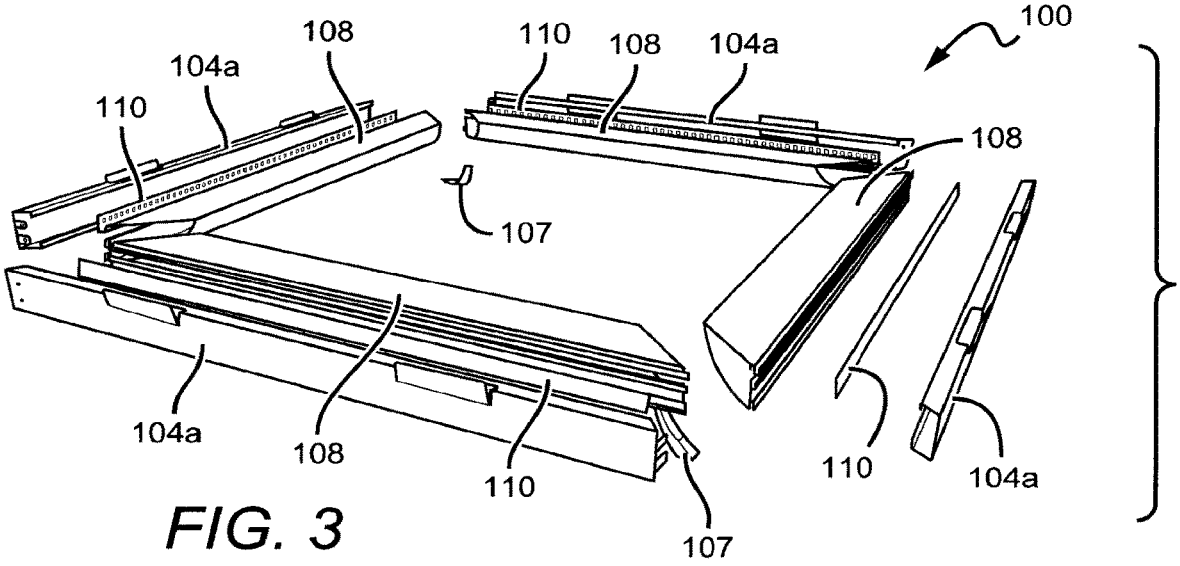
FIG. 3
FIG. 4
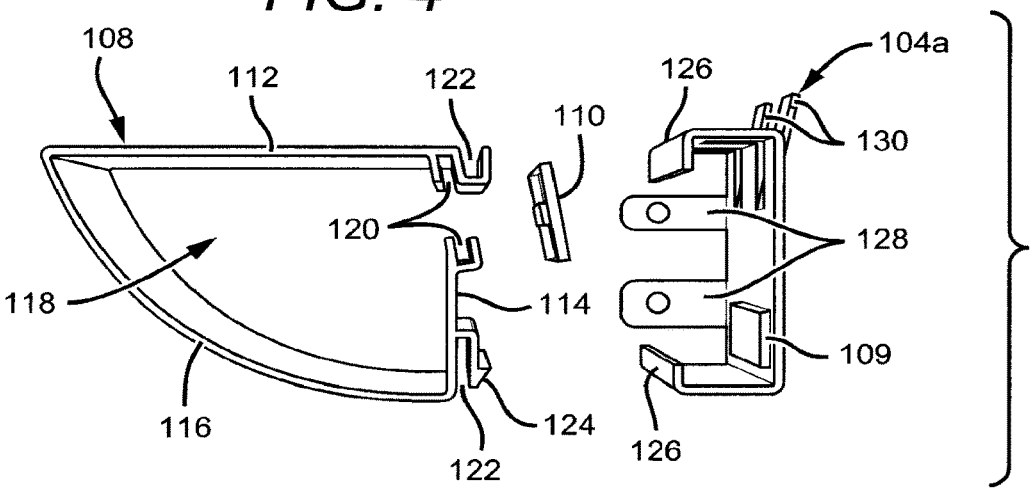
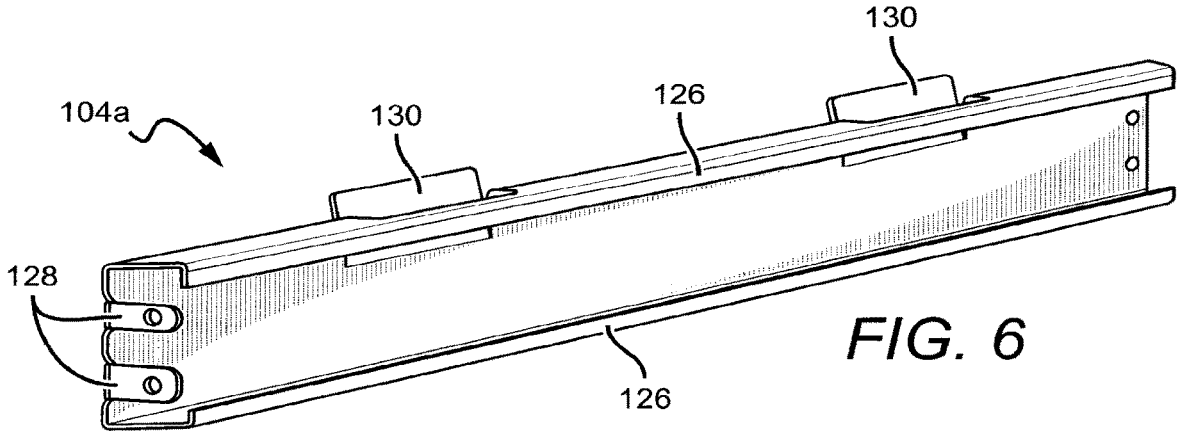
FIG. 6

FIG. 5
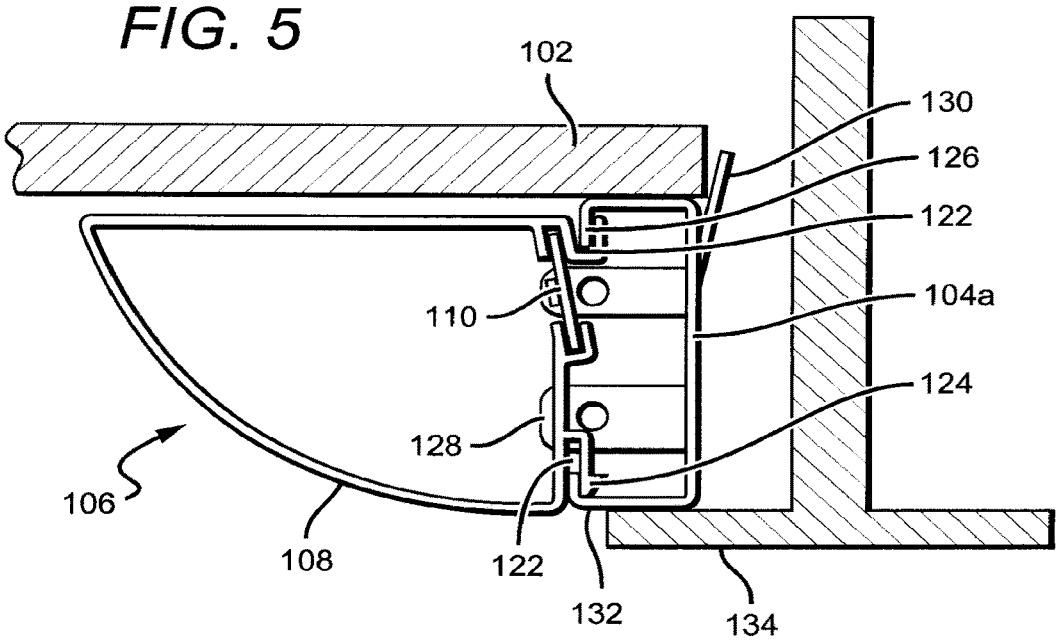
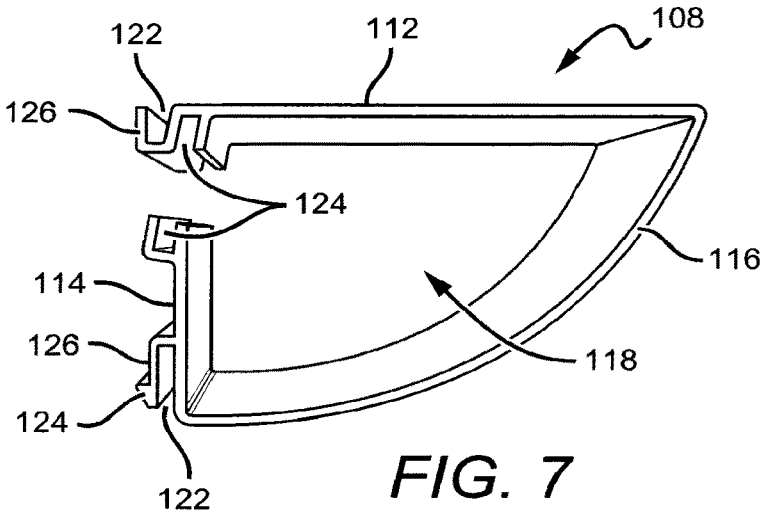
FIG. 7
FIG. 8
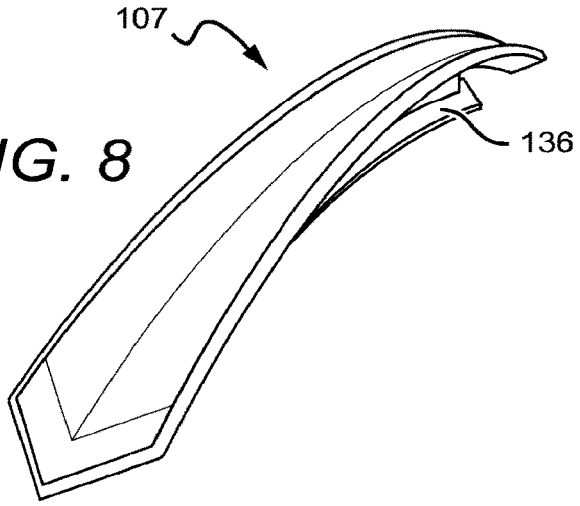

FIG. 9
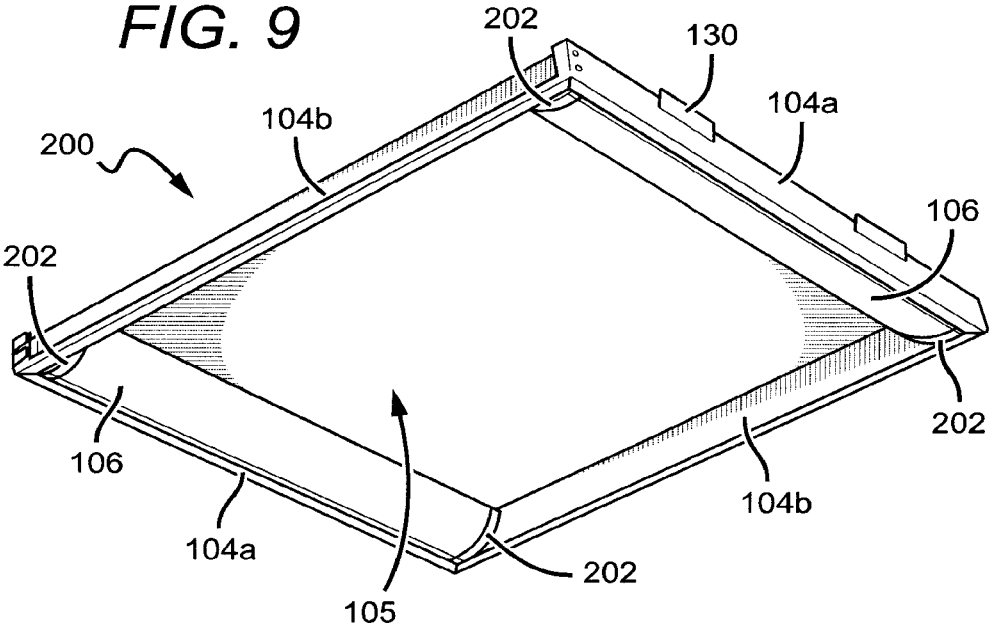
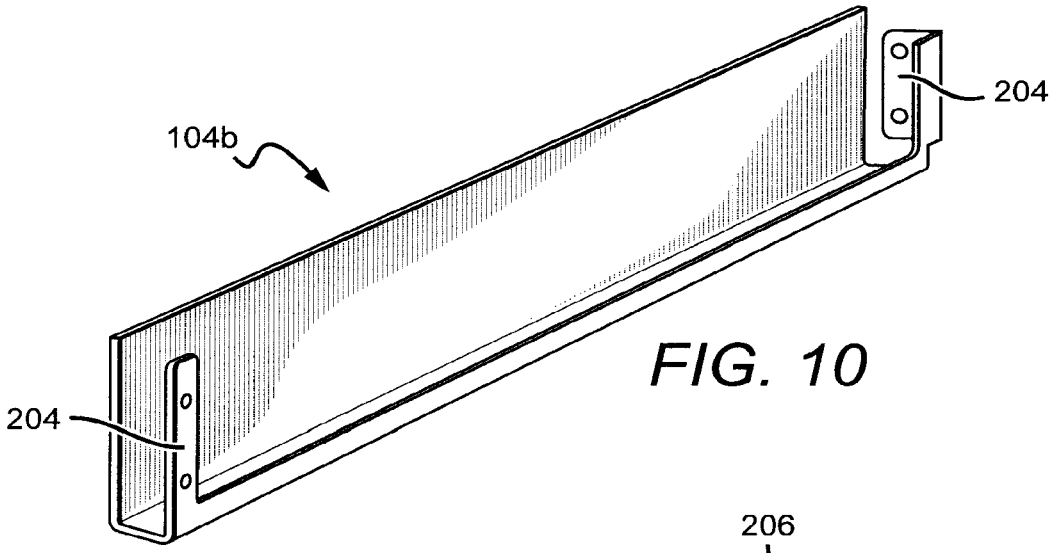
FIG. 10
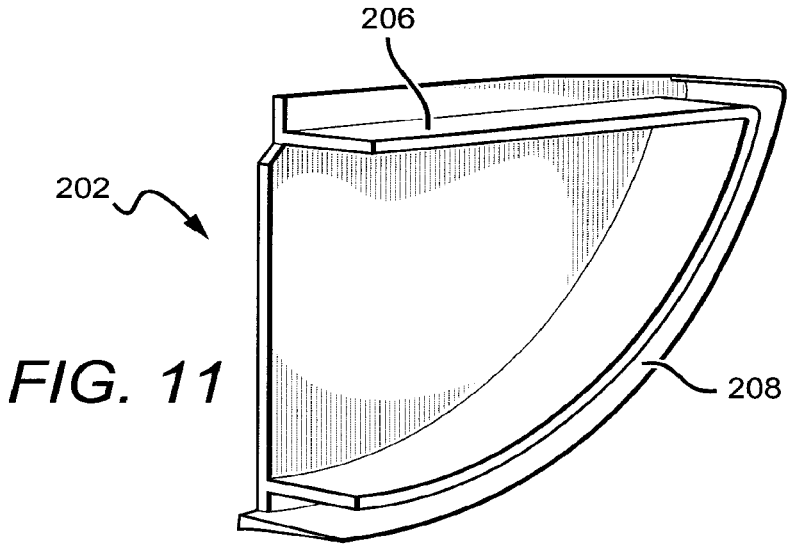
FIG. 11

FIG. 18
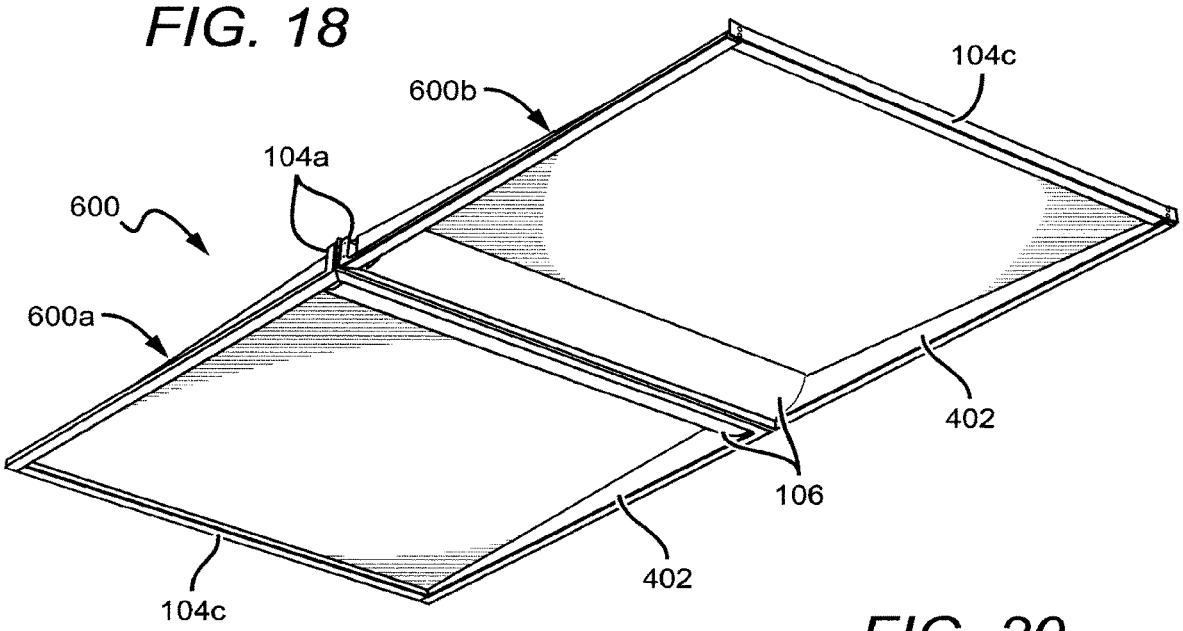
FIG. 20
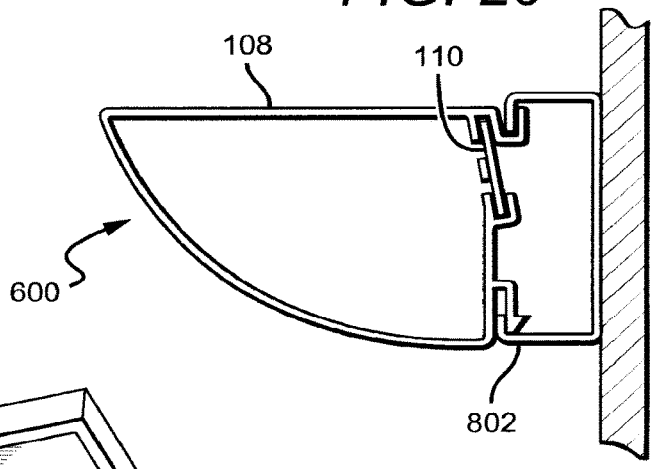
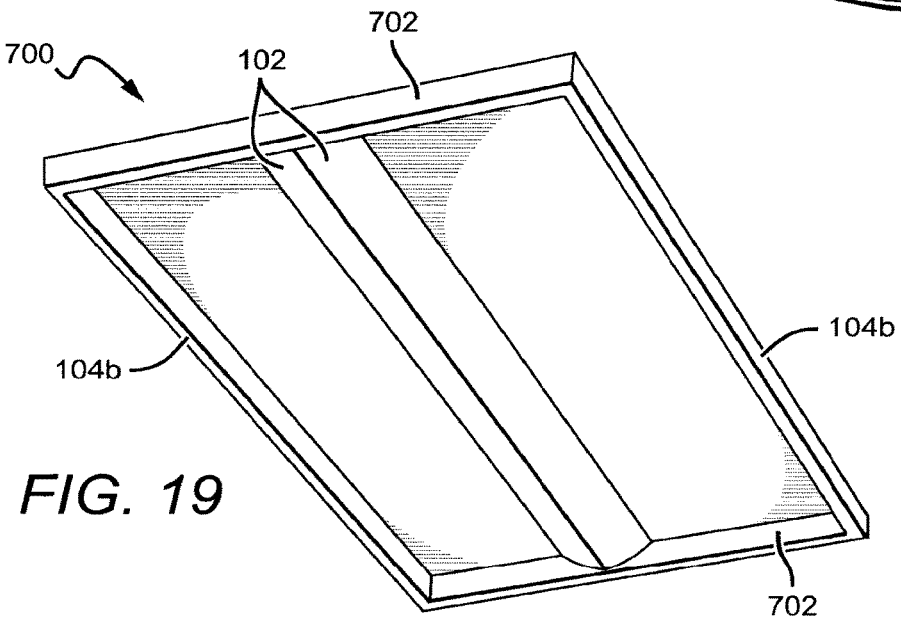
FIG. 19

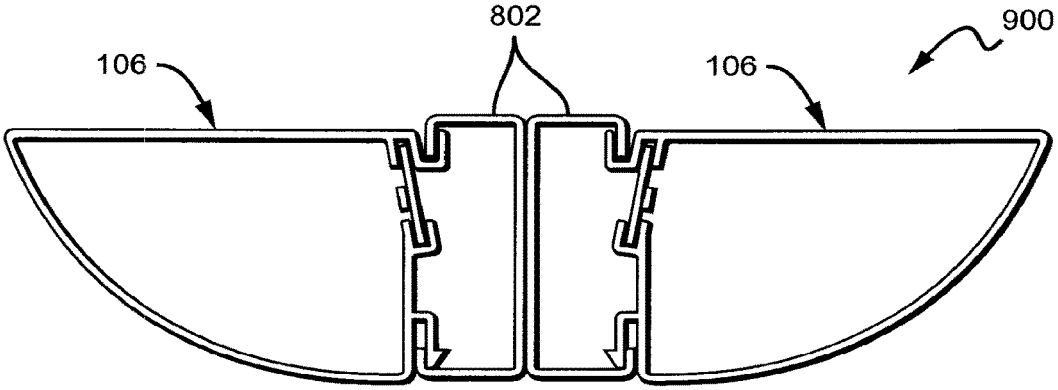
FIG. 21
FIG. 22
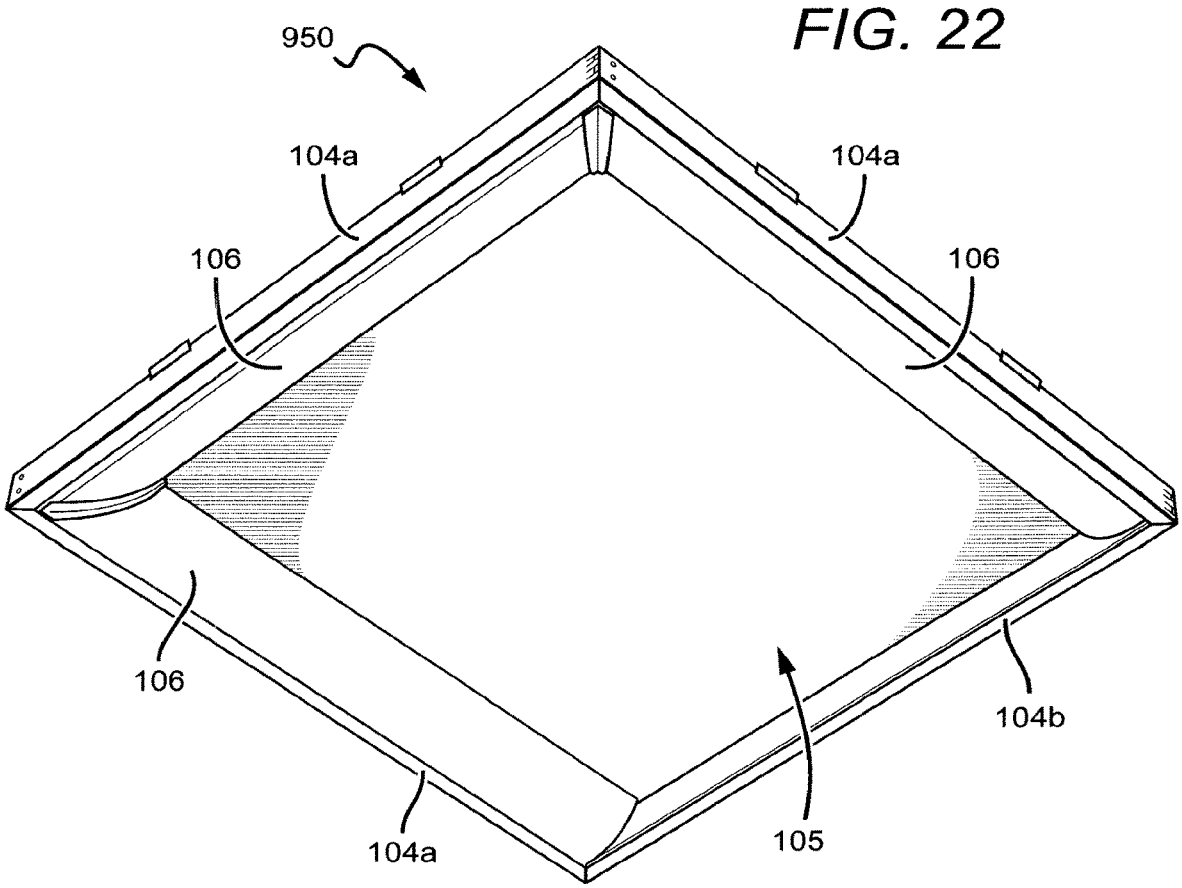

FIG. 26
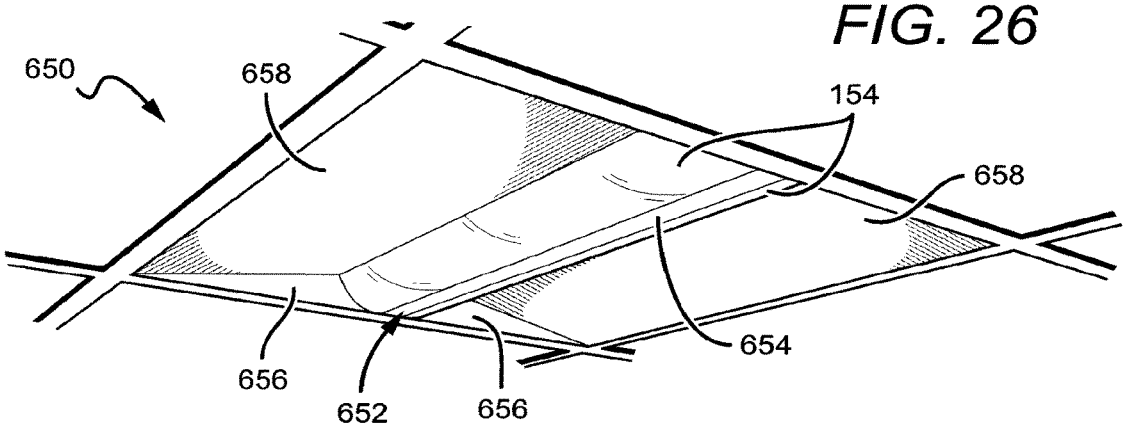
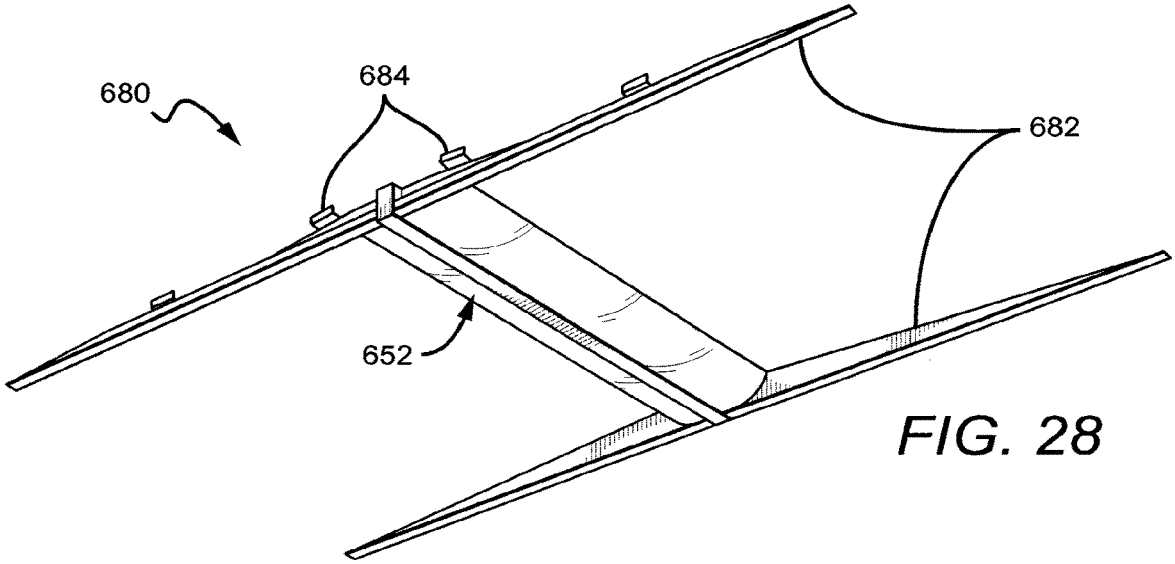
FIG. 28
FIG. 30
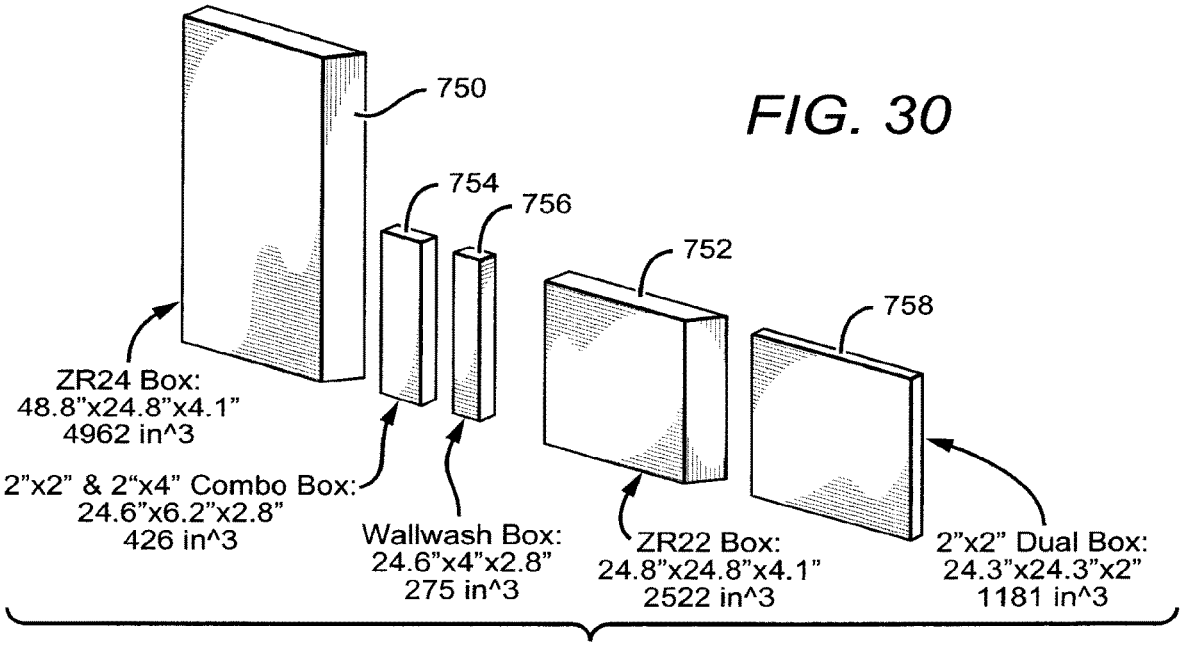

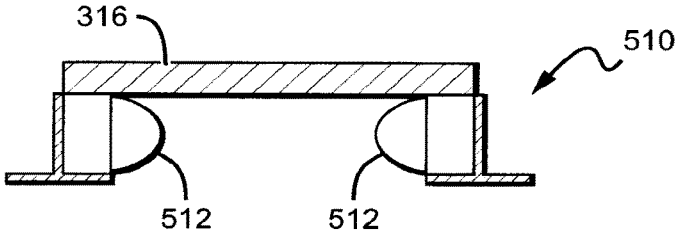
FIG. 32
FIG. 33a
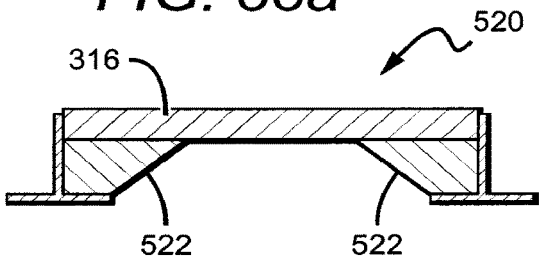
FIG. 33b
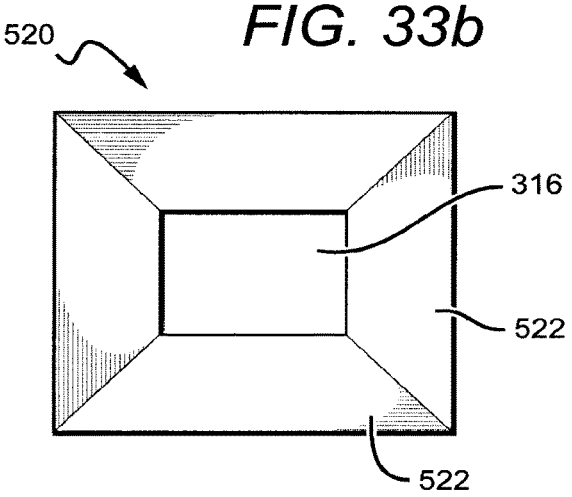
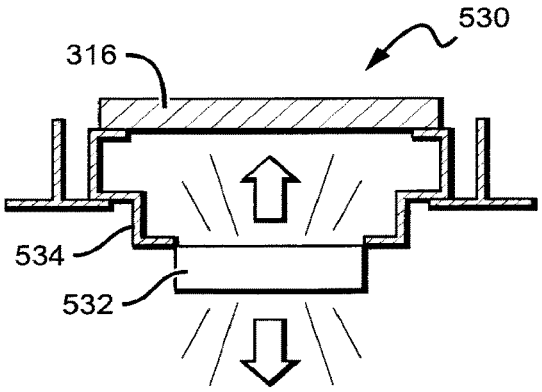
FIG. 34
FIG. 35
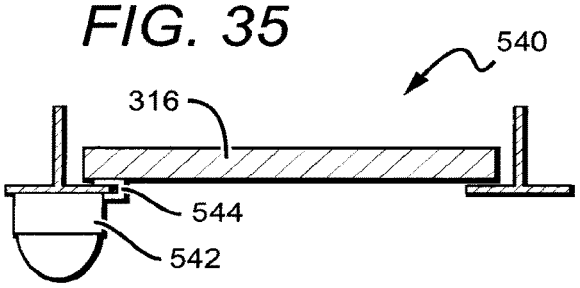
FIG. 36
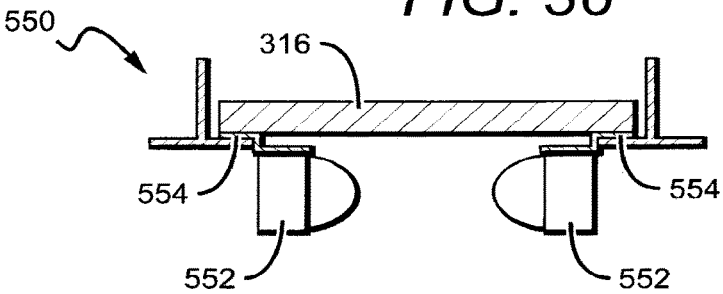

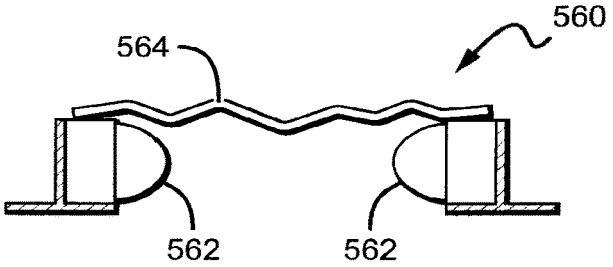
FIG. 37
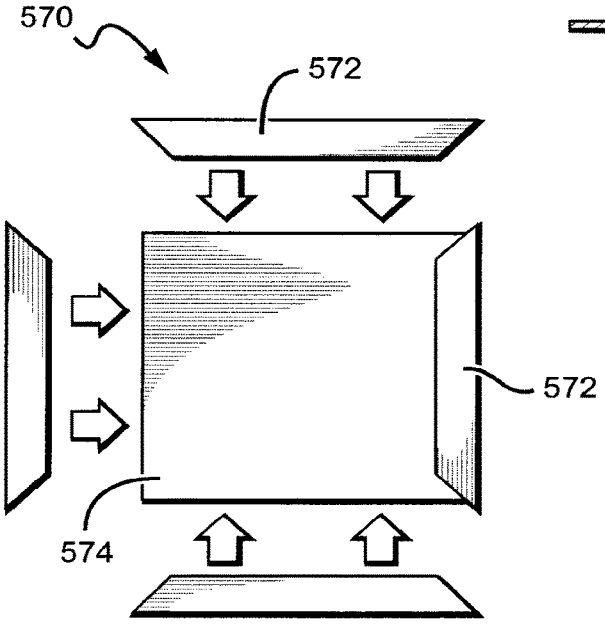
FIG. 38a
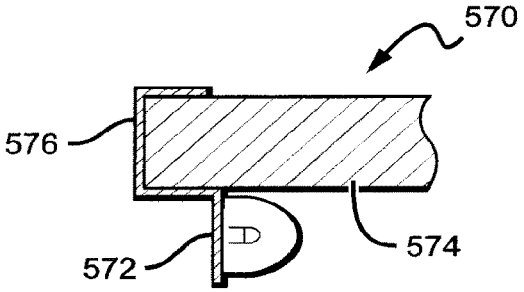
FIG. 38b
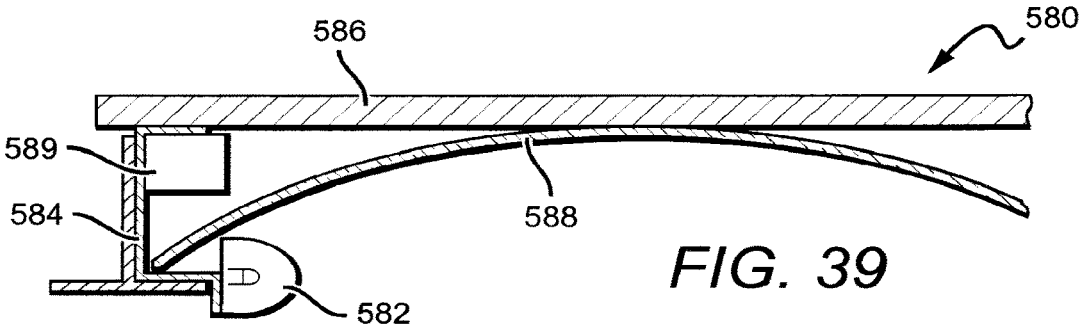
FIG. 39
FIG. 40
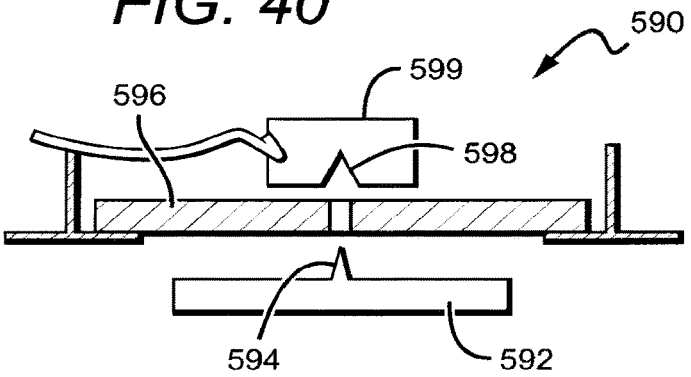

FIG. 41
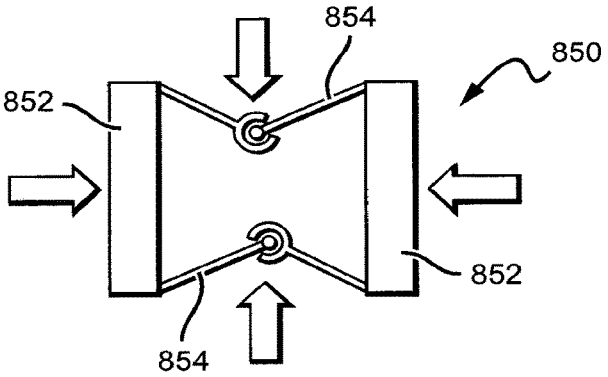
FIG. 42
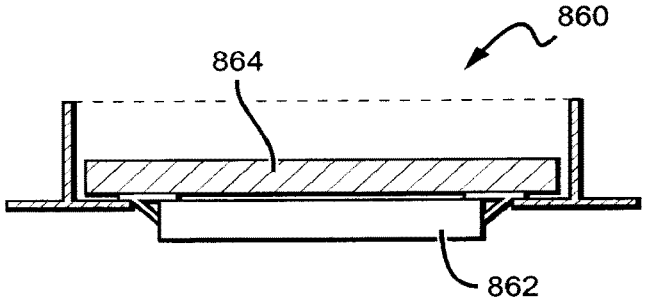
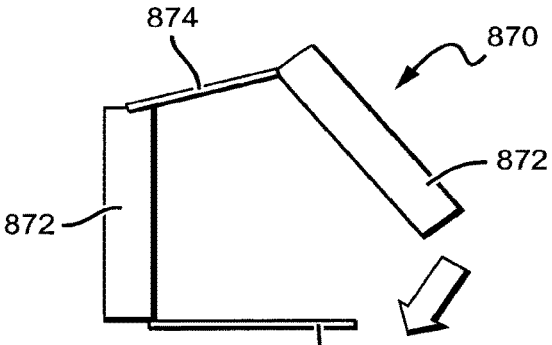
FIG. 43
FIG. 44
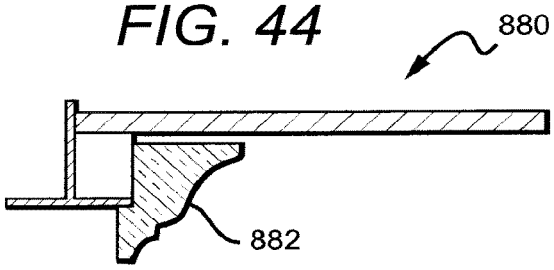
FIG. 45
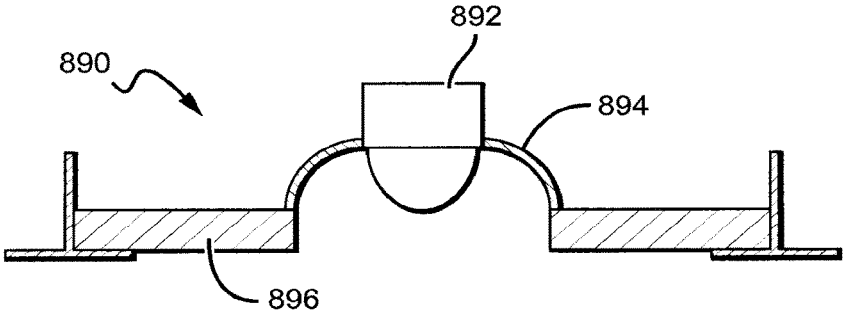

EDGE LIT FIXTURE

RELATED APPLICATION

This divisional application claims the benefit of U.S. patent application Ser. No. 14/622,821, filed Feb. 13, 2015, which in turn is continuation-in-part of U.S. patent application Ser. No. 14/526,368, filed on 28 Oct. 2014, the contents of each are incorporated herein by reference in their entirety.

BACKGROUND OF THE INVENTION

Field of the Invention

The invention relates to retrofit fixtures and systems and methods for lighting installations, and in particular, to fixtures, systems, and methods used to retrofit lighting installations with LED light sources.

Description of the Related Art

Troffer-style fixtures are ubiquitous in commercial office and industrial spaces throughout the world. In many instances these troffers house elongated tubular fluorescent lamps or light bulbs that span the length of the troffer. Troffers may be mounted to or suspended from ceilings, such as by suspension from a "T-grid". Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, these troffers have been used with LEDs as their light source. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are energy-inefficient sources with approximately ninety percent of the electricity they consume being released as heat rather than light. Fluorescent light bulbs are more energy-efficient than incandescent light bulbs by a factor of about 10, but are still relatively inefficient compared to LEDs, which can provide the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs, such as in the range of approximately 10,000-20,000 hours, but provide less desirable color. In comparison, LEDs can have lifetimes between 50,000 and 70,000 hours. The increased efficiency and extended lifetime of solid state sources has resulted in widespread adoption of LEDs in place of conventional light sources in many different applications. It is predicted that further improvements will result in their general acceptance in more and more lighting applications. Movement toward universal usage of LEDs in place of incandescent or fluorescent lighting will result in increased lighting efficiency and significant energy saving.

There has been recent interest in upgrading existing troffer-style lighting systems with LED sources (or light engines) to capitalize on the above advantages. Current options for upgrading include complete fixture replacement such as by the commercially available CR Series Architectural LED Troffer, provided by Cree, Inc. Some features of these troffers are described in U.S. patent application Ser. No. 12/873,303, titled "TROFFER-STYLE FIXTURE", and assigned to Cree, Inc. Performing complete fixture replacement can require penetrating the ceiling plenum by a skilled technician. This can be time consuming and expensive, and in many locations, building codes can require that a licensed electrician perform any work in the plenum space above a ceiling.

During the upgrade process, contamination may also be a concern, particularly in a hospital or clean room environment. In upgrade processes where the entire fixture is replaced, the sheet metal pan or housing of an existing troffer lighting system is removed. Removing the "host fixture" pan can generate dust which must be contained and cleaned prior to resuming normal operations within the environment. Preventing dust is of particular concern areas known to contain hazardous building materials, such as asbestos. In certain environments, construction permits may be required for an upgrade process that requires removal of the troffer pan, which can add additional complication and cost.

Another alternative upgrade option is by fixture retrofit where a new LED-based light engine can be installed into the sheet metal pan of an existing troffer lighting system. This can provide the advantage of using light engines with design features such as reflectors, lenses, and power supplies which have been optimized for an LED-based system. It also allows light engines which are approved for use in other applications to be used in a retrofit application. Examples of LED-based retrofit kits are discussed in detail in U.S. patent application Ser. No. 13/464,745, titled "MOUNTING SYSTEM FOR RETROFIT LIGHT INSTALLATION INTO EXISTING LIGHT FIXTURES" (now U.S. patent Ser. No. 10/544,925), which is commonly assigned with the present application to Cree, Inc. and incorporated by reference as if set forth fully herein. Some retrofits do not require the removal of the existing troffer pan prior to installation, with the pan acting as a barrier to the plenum space. Leaving the pan intact during the retrofit process does not disturb wiring connections, insulation, etc., above the ceiling plane. Leaving the pan in place can also allow for work to be performed by non-licensed personnel, which can eliminate costs for work that is required to be performed by licensed electricians. In some current retrofit products, replacement lamps or LED light engines are held into the existing fixture or sheet metal pan with brackets and screws. Some of these arrangements may require penetrating the ceiling, and some of these installations can be slow and labor-intensive.

Other upgrades involve replacing the fluorescent light bulbs/tubes with replacement tubes having LEDs along their length. This upgrade can utilize existing fluorescent lamp fixtures including the electrical ballast and wiring. However, compared to light engines designed to capitalize on the characteristics of LEDs, these replacement lamps can require much more energy for a given light output (lower efficacy), provide little to no cost benefit. In addition, the tubular format relies on the existing optical reflectors and lenses, which were designed for the light distribution characteristics of a fluorescent source.

SUMMARY OF THE INVENTION

One embodiment of a light fixture according to the present invention comprises the following elements. An elongated lens comprises an exit side and is shaped to define an internal optical cavity. An elongated frame is shaped to engage with said lens. A light strip comprises at least one light source mounted thereon, and the light strip is held in place by the lens such that at least some light emitted from the at least one light source is emitted into the optical cavity and impinges on the exit side of the lens.

One embodiment of a light fixture according to the present invention comprises the following elements. At least one light panel, each of the light panels comprising: an elongated lens comprising an exit side, the lens shaped to define an internal optical cavity, and a light strip comprising at least one light source mounted thereon. The light strip is positioned such that at least some light emitted from the at least one light source is emitted into the optical cavity and impinges on the exit side. A housing comprises at least one lens frame for supporting the at least one light panel.

One embodiment of an elongated lens according to the present invention comprises: a first structural side; a second structural side; and a light-transmissive exit side spanning between an end of the first structural side and an end of the second structural side. The first structural side, the second structural side, and the exit side define an internal optical cavity. Ends of the first and second structural sides distal to the exit side are cooperatively shaped to form a slot for receiving a light strip.

One embodiment of a light fixture comprises the following elements. A housing defines an open central area. At least one light panel is on an interior surface of the housing such that the at least one light panel is positioned to emit at least some light toward the central area.

One embodiment of a light fixture configured for use in a ceiling space comprises the following elements. A housing is provided for placement along at least one side of a perimeter of an opening in the ceiling. At least one light panel is attached to the housing, the light panel only along the perimeter of the opening.

One embodiment of a light fixture comprises the following elements. A light engine comprises a mount plate, an elongated compartment on the mount plate, at least one elongated lens, the lens attachable to the mount plate and an exterior surface of the compartment such that the mount plate, the compartment, and the lens define an optical cavity, and a light strip comprising at least one light source on the mount plate such that the at least one light source is positioned to emit at least some light into the optical cavity and through the lens.

A light fixture comprises the following elements. At least one light engine, with each of the light engines comprising: a mount plate; an elongated compartment on the mount plate; at least one elongated lens, the lens attachable to the mount plate and an exterior surface of the compartment such that the mount plate, the compartment, and the lens define an optical cavity; a light strip comprising at least one light source on the mount plate such that the at least one light source is positioned to emit at least some light into the optical cavity and through the lens; and a driver circuit housed within the compartment. The fixture further comprises a plurality of legs for supporting the at least one light engine.

A light fixture comprises the following elements: a structure defining at least one open area, the structure comprising: at least one light engine on an interior surface of the structure such that the at least one light engine is positioned to emit at least some light toward the at least one open area; and a plurality of legs extending from the at least one light engine.

These and other further features and advantages of the invention would be apparent to those skilled in the art from the following detailed description, taken together with the accompanying drawings, in which:

BRIEF DESCRIPTION OF THE DRAWINGS

FIG. 1 is a perspective view of a light fixture according to an embodiment of the present invention.

FIG. 2 is a perspective view of a fixture according to an embodiment of the present invention.

FIG. 3 is an exploded view of a fixture according to an embodiment of the present invention.

FIG. 4 is an exploded view of light panel and a lens frame according to an embodiment of the present invention.

FIG. 5 is a cross sectional view of one side of a fixture according to an embodiment of the present invention.

FIG. 6 is a perspective view of the lens frame which may be used in embodiments of the present invention.

FIG. 7 is a close-up perspective view of one end of an elongated lens which may be used in embodiments of the present invention.

FIG. 8 is a close-up perspective view of an angled joint cap that may be used in embodiments of the present invention.

FIG. 9 is a perspective view of a fixture according to an embodiment of the present invention.

FIG. 10 is a close-up perspective view of a side frame that may be used in embodiments of the present invention.

FIG. 11 is a close-up perspective view of an end cap that may be used in embodiments of the present invention.

FIG. 18 is a perspective view of a modular fixture according to an embodiment of the present invention.

FIG. 19 is a perspective view of another fixture according to an embodiment of the present invention.

FIG. 20 is a cross-sectional view of a fixture according to an embodiment of the present invention.

FIG. 21 is a cross-sectional view of a fixture according to an embodiment of the present invention.

FIG. 22 is a perspective view of a fixture according to an embodiment of the present invention.

FIG. 26 is a perspective view of a fixture according to an embodiment of the present invention.

FIG. 28 is a perspective view of a fixture according to an embodiment of the present invention.

FIG. 30 is a perspective view of cartons that may be used to ship embodiments of the present invention in comparison with cartons used to ship typical troffer style fixtures currently in the market.

FIG. 32 is a side cross-sectional view of a fixture according to an embodiment of the present invention.

FIG. 33*a* is a side cross-sectional view of a light fixture according to an embodiment of the present invention. FIG. 33*b* is a bottom plan view of the fixture.

FIG. 34 is a side cross-sectional view of a fixture according to an embodiment of the present invention.

FIG. 35 is a side cross-sectional view of a fixture according to an embodiment of the present invention.

FIG. 36 is a side cross-sectional view of a fixture according to an embodiment of the present invention.

FIG. 37 is a side cross-sectional view of a fixture according to an embodiment of the present invention.

FIG. 38*a* is a bottom plan view of a fixture according to an embodiment of the present invention. FIG. 38*b* is a side cross-sectional view of a portion of the fixture.

FIG. 39 is a side cross-sectional view of a portion of a fixture according to an embodiment of the present invention.

FIG. 40 is a side cross-sectional view of a fixture according to an embodiment of the present invention.

FIG. 41 is a bottom plan view of a fixture according to an embodiment of the present invention.

FIG. 42 is a side cross-sectional view of a fixture according to an embodiment of the present invention.

FIG. 43 is a bottom plan view of a fixture according to an embodiment of the present invention.

FIG. 44 is a side cross-sectional view of a portion of a fixture according to an embodiment of the present invention.]

FIG. 45 is a side cross-sectional view of a fixture according to an embodiment of the present invention.

DETAILED DESCRIPTION OF THE INVENTION

Figure 12:
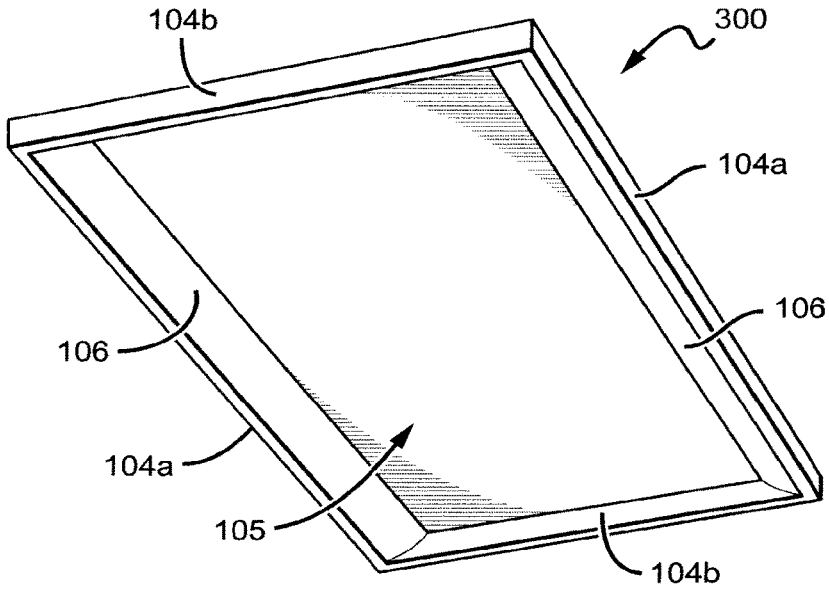
FIG. 12 is a perspective view of a fixture according to an embodiment of the present invention.

Embodiments of the present invention provide edge lit fixture systems that can be used with different light fixtures, but that are particularly adapted for use with common ceiling structures. These fixture systems can be used with many different light sources but are particularly well-suited for use with solid state light sources such LEDs. Some embodiments of the present invention comprise a mechanical mounting system for installing an LED light source within an existing lighting system housing or pan, such as a troffer pan, without penetrating the ceiling plenum. Other embodiments may be installed in typical commercial tile ceiling that utilize a T-grid infrastructure.

By leaving the existing ceiling tile in place, embodiments of the present invention can utilize the existing material to function as an illuminated back surface and a barrier to the plenum. Thus, embodiments of the light fixture can be installed around existing materials, reducing the amount and cost of materials necessary for installation.

The spacing between the vertical members of the T-grid is usually consistent in commercial and industrial buildings. By taking advantage of this regularity, a framing system can be used to create a means to attach a lens or fixtures to a large number of T-Grid ceilings. Some embodiments of the present invention can comprise components, inserts, panels or mounts arranged on and spanning across the ceiling T-grid, to form a housing frame and fixture for a light source. In some embodiments, a housing can rest on the horizontal lip of the T-grid, at least partially spanning the T-grid opening to provide a structure to support the light source, for example, an LED-based light panel. In some of these embodiments, the housing can be located in and supported directly by the ceiling T-grid. Embodiments of the fixtures can be erected quickly and easily without requiring tools, fasteners or adhesives, but it is understood that in other embodiments they can be used.

Some embodiments of the present invention comprise a housing that rests on or is attached to the horizontal portion of a T-grid. The housing defines the fixture area, which in some embodiments is rectangular, for example, 2 ft. by 2 ft. Other embodiments may have different dimensions, such as 2 ft. by 4 ft. or 1 ft. by 4 ft., for example. The housing comprises at least one lens frame for supporting a linear lens. In some embodiments, the housing can be constructed from collapsible housing subassemblies. For example, a rectangular housing may be assembled from first and second collapsible housing subassemblies that pivot about a hinge and lock together to create a rigid housing. The housing comprises at least one elongated lens frame, with each lens frame supporting a light panel. The housing may also comprise side frames and end frames to give the housing its shape, for example, a rectangular shape. Each light panel comprises an elongated lens and a light strip held in place by the lens.

Embodiments of the present invention require minimal material, especially sheet metal, and are easily collapsible such that they can fit into smaller cartons for shipping. Some of the fixtures described herein fit into shipping cartons that are roughly 1/10 the size of cartons used to ship current products on the market that perform a similar function with a comparable form factor. The unassembled products may be shipped to customers for assembly into a variety of configurations depending on the desired application. Thus, embodiments of the present invention provide a versatile light fixture in which unnecessary materials have been eliminated, reducing costs both associated with the materials themselves and with shipping those materials.

The present invention is described herein with reference to certain embodiments, but it is understood that the invention can be embodied in many different forms and should not be construed as limited to the embodiments set forth herein. In particular, the present invention is described below in regards to certain fixture systems that can be used to retrofit and/or upgrade troffer-style fixtures or lighting systems, but it is understood that the system can be used to retrofit and/or upgrade other types of lighting systems as well. The retrofit systems can also be used with many different light systems, sources, panels, and engines beyond those described herein, with many being LED-based.

It is understood that when an element can be referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source, such as in a light bar, for example. Thus, the term "source" should not be construed as a limitation indicating either a single-element or a multi-element configuration unless clearly stated otherwise.

Embodiments of the invention are described herein with reference to schematic illustrations. As such, the actual thickness of elements can be different, and variations from the shapes of the illustrations as a result, for example, of manufacturing techniques and/or tolerances are expected. Thus, the elements illustrated in the figures are schematic in nature. The illustrations are not intended to illustrate the precise shape or relative size of an element and are not intended to limit the scope of the invention.

FIG. 1 is a perspective view of a light fixture according to an embodiment of the present invention. This particular embodiment is built to fit a rectangular fixture opening in a ceiling have a length-to-width ratio of 1:1, although it is understood that other systems may be designed for openings having other shapes and dimensions. In this embodiment the fixture 100 is recessed into the plenum with a bottom surface of the fixture 100 resting on a horizontal lip of the T-grid. Here, the original ceiling tile 102 remains as a functional part of the light fixture, serving as a reflective back surface of the fixture 100.

FIG. 2 is a perspective view of the fixture 100 removed from the ceiling. A housing 104 is mounted to the ceiling around the perimeter of the ceiling opening. The housing 104 can comprise multiple discrete segments and provides the base structure to which one or more light panels 106 can be attached. In this embodiment, the housing 104 comprises four segments, namely, four lens frames 104*a* that are arranged along only the perimeter of the fixture 100, defining an open central area 105 inside the housing 104. Thus, this particular fixture 100 is a 2 ft. by 2 ft. fixture with four 2 ft. light panels 106 around the interior perimeter of the fixture. Here, the light panels 106 substantially span the entire interior edge of the perimeter of the ceiling opening. These light panels 106 are shaped and positioned to emit at least some light toward the central area 105 and into the room below. The four light panels 106 are arranged to provide a perimeter-in light distribution that is characterized by an even quadrilateral floor distribution with minimal light output at high angles.

It may be desirable in some applications to paint visible portions of the housing 104. The housing 104 may be painted to match the ceiling environment or a particular color scheme, or it may be painted white to improve reflectivity.

The fixture 100 (and some of the other fixtures discussed herein) illuminates a room from the edge of the T-grid rather than from the center of the fixture, which offers a more uniform output. The central area 105 of inside the fixture 100 remains open. As shown in FIG. 1, an existing ceiling tile 102 may be laid over the top of the fixture 100 such that light that passes through the open space will be reflected back into the room environment. That is, the ceiling tile 102 may be used as a reflective back surface. In some embodiments, it may be desirable to dispose a reflective sheet or panel between the housing 104 and the ceiling tile 102 to provide or more reflective back surface, especially if the ceiling tile 102 is a poor reflector. In other embodiments, other materials may be used between the housing 104 and the ceiling tile 102 such as gels, filters, or diffusers, for example. These materials may be employed as lay-ins, or they may be applied directly to a surface of the ceiling tile 102 or another surface.

In this rectangular configuration, the light panels 106 abut one another at their ends in a mitered corner. An angled joint cap 107 is positioned at each joint to finish the lens and create a more visually appealing transition between the light panels 106. As noted, the ceiling tile 102 can remain as a functional component in the fixture 100, for example, as a reflective illuminated surface. The housings of other embodiments disclosed herein have additional types of frame components, such as side frames and end frames, for example.

FIG. 3 is an exploded view of the fixture 100. As shown, the housing 104, which in this embodiment comprises four lens frames 104*a* arranged in a rectangular configuration, defines the perimeter of the structure. Other embodiments include different types of housing segments including side frames 104*b* and end frames 104*c* (neither shown in FIG. 3). The modular versatility of the housing 104 assembly allows fixtures to be arranged in a variety of configurations, several of which are discussed herein. The light panels 106 are mounted to the interior-facing portion of the lens frames 104*a*. Each light panel 106 comprises an elongated lens 108 and a light strip 110 which is held in place by the lens 108 as best shown in FIG. 5.

FIG. 4 is an exploded view of light panel 106 (i.e., the lens 108 and the light strip 110) and the lens frame 104*a*. The lens comprises first and second structural sides 112, 114 and a light-transmissive exit side 116. The three sides 112, 114, 116 define a partially enclosed interior optical cavity 118. The distal ends of the structural sides 112, 114 (i.e., the ends not joined to the exit side 116) are cooperatively shaped to form a slot 120 that receives the light strip 110. The light strip 110 may be slid into the slot 120 prior to or after fastening the lens 108 to the lens frame 104*a*, providing for easy maintenance or replacement of the light strip 110 or individual sources thereon. The first and second structural sides also comprise flanges that define channels 122 for receiving the lens frame 104*a*. The flange on the second structural side 114 comprises a barbed leg 124 for snap-fit attachment to the lens frame 104*a*.

In some embodiments, the light strips 110 can comprise a linear array of light emitting diodes (LEDs), although it is understood that other light sources can also be used. Each of the LEDs can emit light with the same characteristics, such as emission intensity, color temperature, and color rendering index. This can result in the particular fixture emitting a substantially uniform emission, with the many industrial, commercial, and residential applications calling for fixtures emitting white light.

In some embodiments, a multicolor source is used to produce the desired light emission, such as white light, and several colored light combinations can be used to yield white light. For example, as discussed in U.S. Pat. Nos. 7,213,940 and 7,768,192, both of which are assigned to Cree, Inc., and both of which are incorporated herein by reference, it is known in the art to combine light from a blue LED with wavelength-converted yellow light to yield white light with correlated color temperature (CCT) in the range between 5000K to 7000K (often designated as "cool white"). Both blue and yellow light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The yellow light is emitted in a much broader spectral range and, thus, is called unsaturated light.

Another example of generating white light with a multi-color source comprises combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to van de Ven et al.

Other light sources can comprise series or clusters having two blue-shifted-yellow LEDs ("BSY") and a single red LED ("R"). BSY refers to a color created when blue LED light is wavelength-converted by a yellow phosphor. BSY and red light, when properly mixed, combine to yield light having a "warm white" appearance. These and other color combinations are described in detail in the previously incorporated patents to van de Ven (U.S. Pat. Nos. 7,213,940 and 7,768,192). The light sources according to the present invention can use a series of clusters having two BSY LEDs and two red LEDs that can yield a warm white output when sufficiently mixed.

The light sources can be arranged to emit relatively even emission with different luminous flux, with some embodiments having light sources that combine to emit at least 100 lumens, while other embodiments can emit at least 200 lumens. In still other embodiments the lighting sources can be arranged to emit at least 500 lumens. Some embodiments may include Cree EasyWhite® LEDs in combination with an analog driver. Other embodiments may include Cree TrueWhite® LEDs with a digital driver that allows the light output to be tuned/dimmed.

In this embodiment, the lens frame 104*a* has a c-shaped cross section. The lens frame 104*a* comprises a flanges 126 shaped to mate with the channels 122 of the lens 108. The lens frame 104*a* also comprises tabs 128 for mounting the fixture to an external surface or for connecting to other housing components. Stops 130 protrude above the top surface of the lens frame 104*a* to provide a surface for the ceiling tile 102 to rest against, holding it in place above the fixture 100, as best shown in FIG. 5.

FIG. 5 is a cross sectional view of one side of the fixture 100. Here, the light panel 106 is attached to and supported by the lens frame 104*a*. The flanges 126 of the lens frame 104*a* are mated with the channels 122 of the lens 108. The barbed leg 124 may engage with a hole on the lens frame 104*a* (not shown in FIG. 5) to provide a snap-fit attachment mechanism. This particular fixture 100 is shown recess mounted in a ceiling plenum such that a bottom surface 132 of the housing 104 is resting on a horizontal lip 134 of a ceiling T-grid. It is understood that the fixture 100 can be mounted in other ways including surface mount, suspension mount, or pendant mount, for example. In this embodiment, the cross sections of the other three sides of the fixture 100 are the same.

FIG. 6 is a perspective view of the lens frame 104*a* which may be used in embodiments of the present invention. In this particular embodiment, the ends of the lens frame 104*a* are beveled to 45° so that they can attach with adjacent segments of the housing 104 with a miter joint. The c-shaped cross section provides an interior space that can house, for example, the light panel 106, or a driver circuit 109 (digital or analog), and/or various other components. The lens frame 104*a* may be constructed of various materials, with some suitable materials being sheet metal or polycarbonate (PC), for example.

FIG. 7 is a close-up perspective view of one end of the elongated lens 108 which may be used in embodiments of the present invention. The lens 108 comprises the first and second structural sides 112, 114 and the exit side 116, which join to define the partially enclosed optical cavity 118. The distal ends of the structural sides 112, 114 are cooperatively shaped to form a slot 120 that receives the light strip 110. The first and second structural sides 112, 114 also comprise flanges that define channels 122 for receiving the lens frame 104*a*. The flange on the second structural side 114 comprises a barbed leg 124 for snap-fit attachment to the lens frame 104*a*. The lens 108 may be constructed using various materials, with one suitable material being polycarbonate, for example. The lens 108 may be extruded to different lengths to accommodate fixtures of various sizes and configurations. In some embodiments, the lens 108 may include diffusive elements.

The lens 108 performs a dual function; it both protects components within the optical cavity 118 and shapes and/or diffuses the outgoing light. In one embodiment, the lens 108 comprises a diffusive element. A diffusive lens 108 functions in several ways. For example, it can prevent direct visibility of the sources and provide additional mixing of the outgoing light to achieve a visually pleasing uniform source. However, a diffusive exit lens can introduce additional optical loss into the system. Thus, in embodiments where the light is sufficiently mixed internally by other elements, a diffusive exit lens may be unnecessary. In such embodiments, a transparent or slightly diffusive exit lens may be used, or the exit lens may be removed entirely. In still other embodiments, scattering particles may be included in the exit lens 108.

Diffusive elements in the lens 108 can be achieved with several different structures. A diffusive film inlay can be applied to a surface of the exit side 116 of the lens 108. It is also possible to manufacture the lens 108 to include an integral diffusive layer, such as by coextruding the two materials or by insert molding the diffuser onto the exterior or interior surface. A clear lens may include a diffractive or repeated geometric pattern rolled into an extrusion or molded into the surface at the time of manufacture. In another embodiment, the exit lens material itself may comprise a volumetric diffuser, such as an added colorant or particles having a different index of refraction, for example.

In certain embodiments, the lens 108 may be used to optically shape the outgoing beam with the use of microlens structures, for example. Microlens structures are discussed in detail in U.S. patent application Ser. No. 13/442,311 to Lu, et al., which is commonly assigned with the present application to CREE, INC. (now U.S. Pat. No. 9,022,601) and incorporated by reference herein.

FIG. 8 is a close-up perspective view of an angled joint cap 107 that may be used in embodiments of the present invention. When assembled, as in fixture 100, angled joint caps 107 are arranged between adjacent light panels 106. The curve of the joint caps 107 mimics the curve of the exit side 116 of the lenses 108 with grooves 136 on both sides to receive the lenses 108. The joint caps 107 are used to finish the lenses 108, preventing light leakage from the ends of the lenses 108 and providing a smooth transition from one light panel 106 to the next. The joint caps 107 also allow for some manufacturing tolerance in the length of the lenses 108 used in the fixture 100. Thus, the lenses 108 may have lengths that slightly deviate from the nominal length and still be incorporated into the assembly without sacrificing visual aesthetics. The joint caps 107 may be constructed from an opaque plastic for example and painted to match components of the housing 104. In other embodiments where the light panels do not abut one another, flat end caps (shown in FIG. 11) may be used to finish the lenses 108 at one or both ends.

FIG. 9 is a perspective view of another fixture 200 according to an embodiment of the present invention. The fixture 200 has many common elements and is similar to the fixture 100 in some respects. For ease of reference, the same reference numerals will be used to identify similar elements throughout the disclosure even though those elements are used in different embodiments. The fixture 200 comprises two light panels 106 arranged at opposite ends of the rectangular housing 104. The light output of the fixture 200 is characterized by an elliptical, symmetrical floor distribution, with the majority of the light along a linear path perpendicular to the lenses 108 and minimal light output at high angles.

In this embodiment, the housing 104 comprises two lens frames 104*a* and two side frames 104*b*. The side frames 104*b* are connected to the lens frames 104*a* at the respective ends and run there between, providing additional structure and shape to the housing 104. The light panels 106 are supported by the lens frames 104*a* at both ends and are positioned on the interior side of the housing 104. In this embodiment, flat end caps 202 cover the ends of the lenses 108. The end caps 202 are used to finish the lenses 108, preventing light leakage from the ends of the lenses 108 and providing a gap-filling element between the lenses 108 and the side frames 104*b*. The end caps 202 also allow for some manufacturing tolerance in the length of the lenses 108 used in the fixture 200.

Within the light panel, the light strip 110 (not shown in FIG. 9) is positioned to emit at least some light toward the exit side 116 of the lens 108. Thus, some of the light will be emitted from the light panel 106 into the room in a direction toward the center of the fixture 200. A smaller portion of the light will be emitted in an upward direction, in some embodiments, toward a ceiling tile 102. The fixture 200 provides an elliptical light output pattern, which is desirable in many environments.

FIG. 10 is a close-up perspective view of a side frame 104*b* that may be used in embodiments of the present invention. The side frame 104*b* comprises mount tabs 204 for connecting to lens frames 104*a*, other side frames 104*b*, and/or end frames 104*c*. The side frames 104*b* add stability to the housing 104 and define the perimeter of the fixture 200.

FIG. 11 is a close-up perspective view of an end cap 202 that may be used in embodiments of the present invention. The flat end caps 202 are used in those embodiments that include a joint between a side frame 104*b* and a lens frame 104*a*, such as the fixture 200, for example. The end caps comprise interior and exterior ridges 206, 208 that mimic the contour of the exit side 116 of the lens 108. The exterior and interior ridges 206, 208 define a thin channel that is shaped and sized to receive an end of the lens 108. The end cap 202 may be constructed from an opaque material, such as PC, for example, and painted to match the color of the housing 104.

FIG. 12 is a perspective view of a fixture 300 according to an embodiment of the present invention. The fixture 300 is similar to the fixture 200 in many respects and shares several elements in common. The fixture 300 features a housing with a 2:1 aspect ratio, with the lens frames 104*a* being twice as long as the side frames 104*b*. In one embodiment, the lens frames 104*a* and the light panels 106 attached thereto are 4 ft. long, and the side frames 104*b* are 2 ft. long. It is understood that the 2:1 aspect ratio is merely exemplary, and that the various components of the fixtures disclosed herein can be adjusted to nearly any dimensions desired. Thus, fixtures according to embodiments of the present invention can be tailored to meet dimensional specifications for many different applications.

Figure 13:
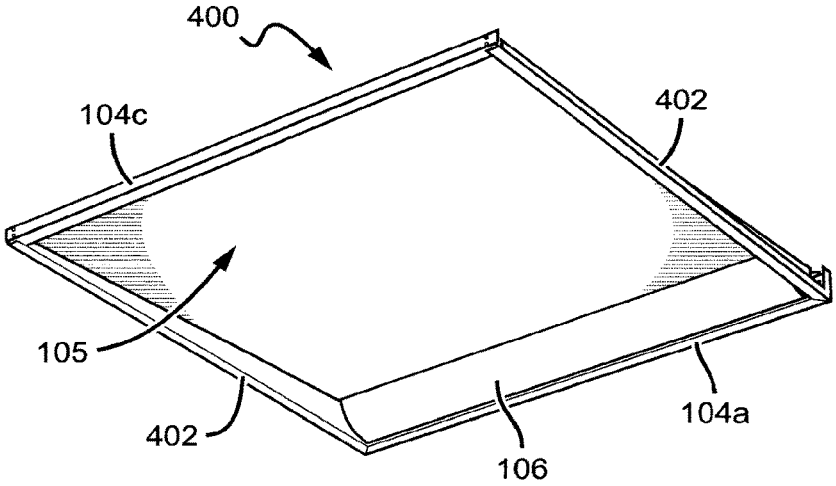
FIG. 13 is a perspective view of a light fixture according to an embodiment of the present invention.

FIG. 13 is a perspective view of a light fixture 400 according to an embodiment of the present invention. The fixture 400 is similar in many respects to the fixture 100 and shares several elements in common. The fixture 400 provides a directional light output that emanates from one side of the fixture 400. Because such fixtures are often mounted near a wall-ceiling junction and can disperse light along a wall, the fixture 400 may sometimes be referred to as a "wall wash" configuration. The light output of the fixture 400 is characterized by an asymmetric elliptical floor distribution with the majority of light directed to one side and minimal light emitted at high angles.

In this embodiment, the housing 104 comprises a lens frame 104*a*, two angled side frames 402, and an end frame 104*c*. The light panel 106 is attached to the lens frame 104*a* on one end of the fixture 400. The angled side frames 400 are connected to the ends of the lens frame 104*a* and extend out to connect the end frame 104*c*. Similarly as the fixture 100, the fixture 400 can be recess-mounted in the plenum by resting the bottom surface of the housing on the horizontal lip of a T-grid, in which case the light panel 106 would substantially span the entire interior edge of the perimeter of the ceiling opening. The fixture 400 can also be mounted in other ways such as surface mounting, suspension mounting, and pendant mounting, for example.

Figure 14:
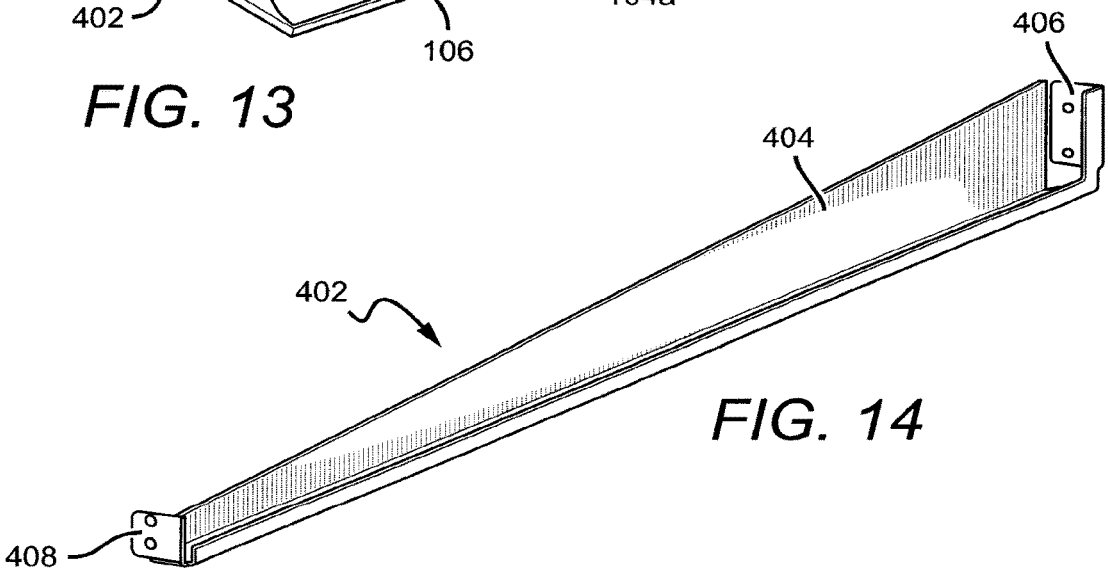
FIG. 14 is a close-up view of an angled side frame that may be used in embodiments of the present invention.

FIG. 14 is a close-up view of an angled side frame 402 that may be used in embodiments of the present invention. The angled side frame 402 is similar to the side frame 104*a* of fixture 100 except that the angled side frame 402 comprises a vertical portion 404 that tapers down as it extends away from the mount tab 406 on the end where the light panel 106 is disposed. The mount tab 408 at the end opposite the light panel 106 is designed to mount to the end frame 104*c* to complete the fixture 400.

Figure 15:
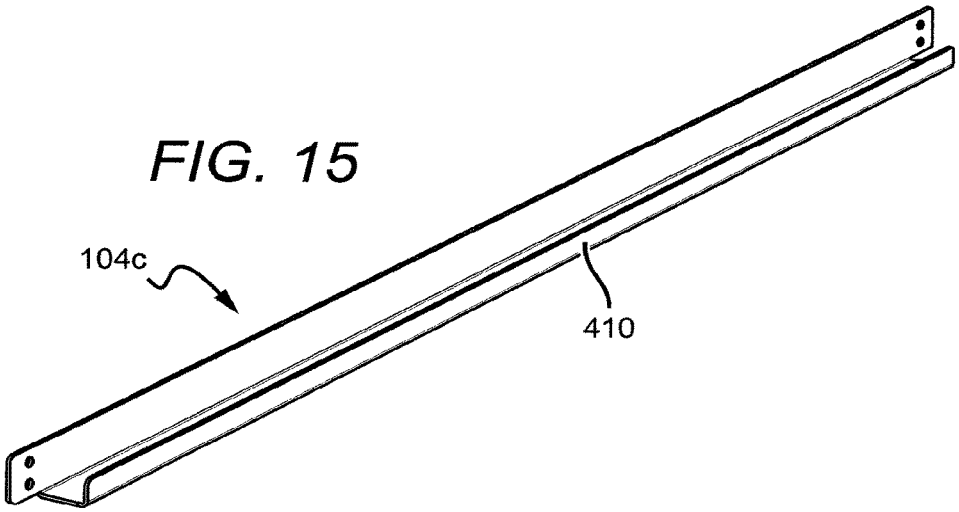
FIG. 15 is a close-up view of the end frame that may be used in embodiments of the present invention.

FIG. 15 is a close-up view of the end frame 104*c* that may be used in embodiments of the present invention. The end frame 104*c* is designed to mount at its ends to the angled side frames 402. The end frame 104*c* comprises a vertical ridge 410 that provides a resting surface for the ceiling tile 102.

Figure 16:
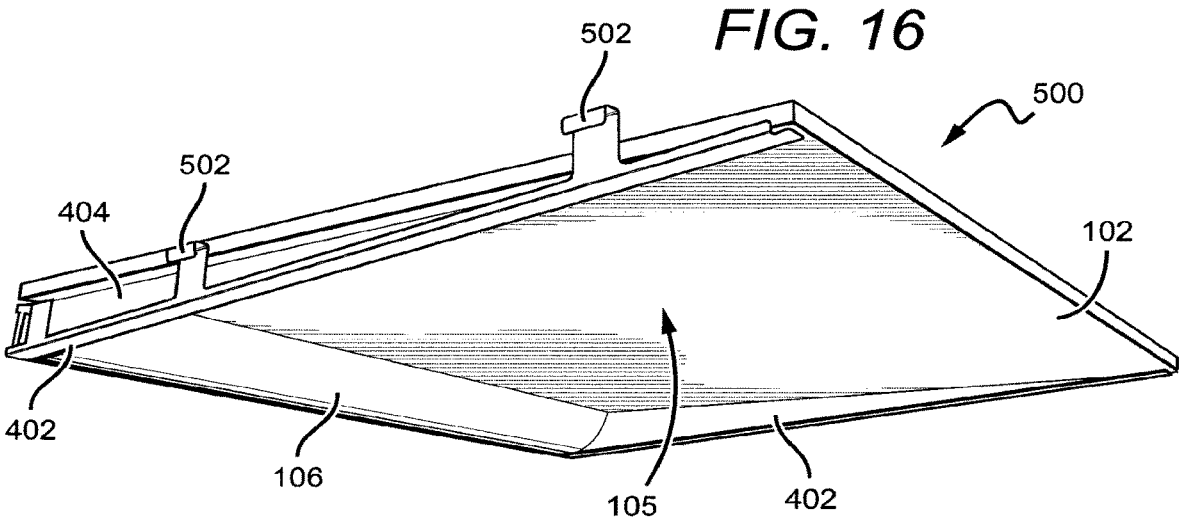
FIG. 16 is a perspective view of a fixture according to an embodiment of the present invention.

FIG. 16 is a perspective view of a fixture 500 according to an embodiment of the present invention. The fixture 500 is similar to the fixture 400 in many respects and shares several common elements. The housing 104 in this embodiment comprises a lens frame 104*a* and two angled side frames 402 connected at the ends of the lens frame 104*a* and extending therefrom. These three components of the housing 104 define the open central area 105. Rather than close the housing 104 with an end frame 104*c*, the side of the housing 104 opposite the light panel 106 is left open in this embodiment. Thus, a ceiling tile 102 can rest on a top surface of the vertical portion 404 of the angled side frames 402 and function as a back surface of the fixture 500. Because the angled side frames 402 taper down as they extend away from the lens frame 104*a*, a ceiling tile 102 thereon will rest at an angle. Thus, some embodiments may include additional stop tabs (not shown) at the distal ends of the angled side frames 402 to keep the ceiling tile 102 from sliding down the side frames 402 as a result of vibrations. In this embodiment, the angled side frames 404 comprise hooks 502 that connect to an external structure to provide additional support for the fixture 500 and to keep it from moving around in the presence of jolts or vibrations, such as an earthquake, for example. In some embodiments the hooks 502 can hang over the vertical portion of a T-grid. Other kinds of support or fastening mechanisms may also be used to secure the fixture 500 to an external structure.

Figure 17:
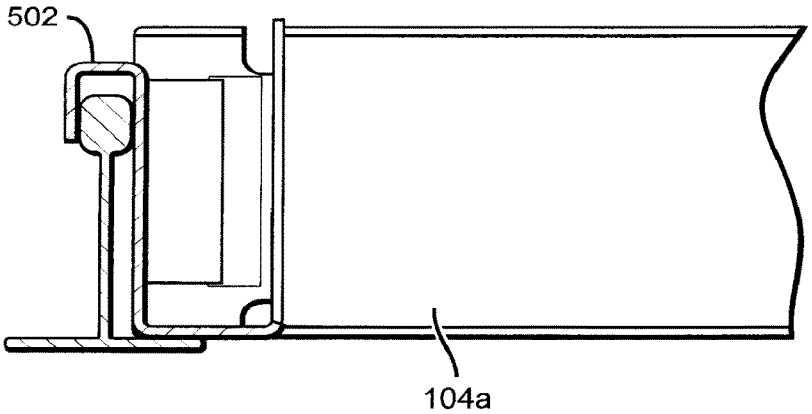
FIG. 17 is a cut-away view of a portion of a fixture according to an embodiment of the present invention.

FIG. 17 is a cut-away view of a portion of the fixture 500. The hook 502 is shown resting over the vertical portion of the T-grid. It is understood that hooks and other fastening mechanisms (e.g., clamps, clips, etc.) can be used in any fixture according to embodiments of the present invention.

FIG. 18 is a perspective view of a modular fixture 600 according to an embodiment of the present invention. In this embodiment, the modular fixture 600 comprises two wall wash type fixtures 600*a*, 600*b*, each similar to the fixture 400 in many respects, disposed in a back-to-back arrangement. Here the lens frames 104*a* of both units are mounted to one another such that the light panels face in opposite directions as shown. It is understood that additional fixtures can be added to the sides or the ends of the modular fixture 600 to achieve a desired light output level or distribution. The fixtures which compose the modular fixture 600 can also be rotated to produce various light output profiles.

FIG. 19 is a perspective view of another fixture 700 according to an embodiment of the present invention. The fixture 700 comprises two light panels 106 mounted directly to one another in a back-to-back configuration. The housing 104 comprises two lens frames 702 and two side frames 104*b*. In this embodiment, the light panels 102 both connect to the lens frames 702 at a central point and extend away in a perpendicular direction, running between the two lens frames 702. Thus, the fixture 700 provides a center-out light distribution as opposed to a perimeter-in distribution as in fixture 100, for example.

FIG. 20 is a cross-sectional view of a fixture 800 according to an embodiment of the present invention. Similar to the fixture 100, the fixture 800 comprises a light panel 102 (lens 108 and light strip 110) attached to a lens frame 802. Here, the lens frame 802 is adapted to mount directly to a surface, such as a wall, for example. The fixture 800 may be mounted with screws, adhesive, or the like.

FIG. 21 is a cross-sectional view of a fixture 900 according to an embodiment of the present invention. The housing 104 comprises two lens frames 802 mounted to one another in a back-to-back configuration such that the light panels 106 face in opposite directions. The top surfaces or the end surfaces of the lens frames 802 may be adapted to mount directly to a surface, or the fixture 900 may be suspension-mounted or pendant-mounted, for example.

FIG. 22 is a perspective view of a fixture 950 according to an embodiment of the present invention. The fixture 950 is similar in many respects to the fixture 100 and shares several common elements. This particular fixture comprises light panels 106 on three sides of the fixture 950 with each light panel 106 connected to a lens frame 104*a*. The side frame 104*b* to provide structure on the single side without a light panel.

Many additional variations are possible. For example, in another embodiment (not pictured), the entire fixture comprises a light panel attached to a single lens frame, such that the lens frame is the only component of the housing. The housing 104 may sit in the horizontal portion of the T-grid or be attached to an external surface as described herein with respect to similar embodiments. Additionally, the fixtures are not limited to a rectangular shape; the housing may be configured in many different shapes, including triangles and other polygons.

Figure 23:
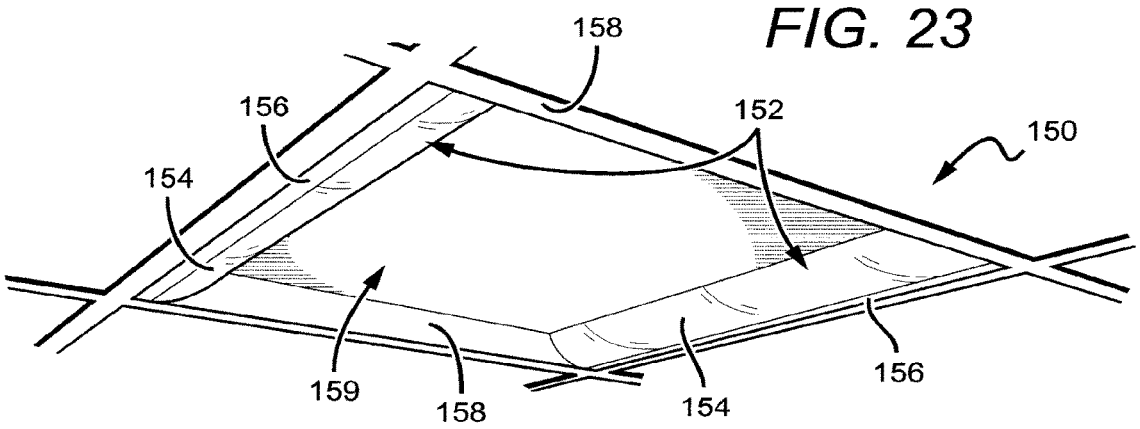
FIG. 23 is a perspective view of a light fixture according to an embodiment of the present invention.

FIG. 23 is a perspective view of a light fixture 150 according to an embodiment of the present invention. The fixture 150 is similar to the fixture 200 shown in FIG. 9. The fixture 150 comprises at least one light engine 152, each of which includes an elongated lens 154 that is removably attached to an elongated compartment 156. This particular embodiment includes two light engines 152 on opposite sides of the ceiling opening. The light engines 152 are arranged around the perimeter of an opening in a ceiling such that each light engine 152 spans an entire length of one side of the opening. Here, two legs 158 on opposite sides of the ceiling opening extend along the perimeter between the two light engines 152. The legs 158 removably attach to the ends of the light engines 152. The legs 158 provide structural support to the fixture 150 and may include attachment mechanisms for attaching the fixture 150 to a ceiling T-grid, for example. In some embodiments, wiring can run along the legs to deliver power to the light engines 152 and provide a connection there between. An electrical connector can be included that allows wiring to be disconnected when not in use so that the legs 158 and the light engine 152 can be easily broken down for shipping and storage. The light engines 152 and the legs 158 define an open area 159 in the center of the fixture 150. In this arrangement, the fixture 150 is recessed into the plenum. The fixture 150 can be customized to fit within any size ceiling opening. The embodiment shown in FIG. 23 is sized to fit within a 2 ft×2 ft square ceiling opening; however, it is understood that other embodiments can fit within other size openings and in openings having a shape other than rectangular.

Figure 24:
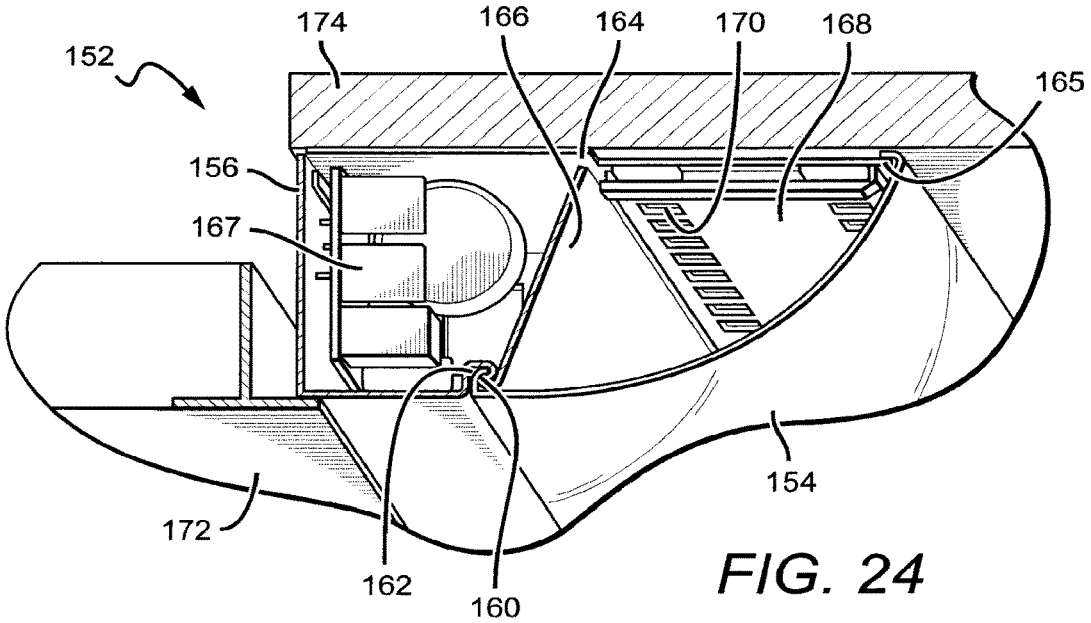
FIG. 24 is a perspective cutaway view of the light engine 152 when the fixture 150 is installed in a ceiling.

FIG. 24 is a perspective cutaway view of the light engine 152 when the fixture 150 is installed in a ceiling. The light engine 152 comprises the lens 154 and the compartment 156 which are removably attached to one another. Here, a lens flange 160 slides into a groove 162 running along the length of the compartment 156. Both the lens 154 and the compartment 156 can attach to a mount plate 164. In one embodiment, the lens 154 is removably attached to the mount plate 164 with a snap-fit structure 165. Thus, the lens 154 can be attached to the mount plate 164 without the use of tools.

When assembled, the mount plate 164, the compartment 156, and the lens 154 define an optical cavity 166. In this embodiment, a light strip 168 comprising at least one light source 170 is mounted to the mount plate 164 such that the light source(s) 170 are positioned to emit at least some light into the optical cavity 166 and through the lens 154. The light source(s) 170 may comprise a plurality of LEDs arranged in various configurations on the light strip 168. The lens 154 can be made from many different materials with one suitable material being plastic. If plastic or another non-conductive material is used, the lens functions not only to shape the outgoing light but also to provide mechanical shielding for the light source(s) 170.

The compartment 156 provides an enclosed space where a driver circuit 167 can be housed. The driver circuit 167 is electrically connected to the light strip 168 to provide power and control the light source(s) 170. The compartment 156 physically isolates the driver circuit 167 from other fixture components to prevent electrical shock during installation and subsequent maintenance.

The light fixture 150 can be mounted in or to the ceiling in many different ways. Here, the fixture 150 is recessed into the plenum such that it is entirely above the ceiling plane. The light engine 152 rests on the horizontal lip of a ceiling T-grid 172. Some embodiments may include clips or latches to further secure the light fixture 150 to the T-grid 172. In this configuration, the light engine 152 is designed to provide a surface to support a top-side reflector panel 174, for example, the ceiling tile that occupied the opening in the ceiling prior to installation of the fixture 150. In this embodiment, the reflector panel 174 sits on the top exterior surface of the mount plate 164 and the top surface of the legs 158 (not visible in FIG. 24). The reflector panel 174 receives light emitted from the light engines 152 into the open area 159 and redirects it back toward the room space that the fixture 152 is intended to light. In other embodiments, reflector panels other than the existing ceiling tile can be used, for example, a sheet metal panel that may be customized for optical control or decoration. Many different reflector panels and materials can be used to achieve a desired light output profile.

Figure 25:
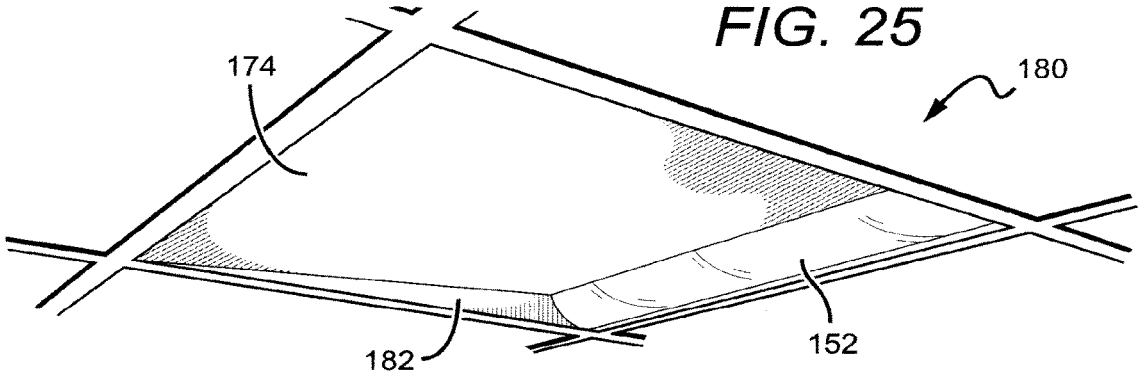
FIG. 25 is a perspective view of a fixture according to an embodiment of the present invention.

FIG. 25 is a perspective view of a fixture 180 according to an embodiment of the present invention. The light engine 152 is the same as in the fixture 150. The fixture 180 comprises tapered legs 182 that extend away from the light engine 152 toward the opposite end of the ceiling opening. A top-side reflector panel 174, e.g., a ceiling tile, rests on top of the light engine 152 and the angled legs 182 such that the reflector panel 174 angles down from the light engine 152 to the opposite edge of the ceiling opening. The fixture 180 only has a light engine 152 on one side of the ceiling opening. Thus, the light distribution is projected heavily to one side of the fixture 180, which may be useful for lighting around the edges of a room or along a wall, for example.

FIG. 26 is a perspective view of a fixture 650 according to an embodiment of the present invention. The fixture 650 is similar to the fixture 600 shown in FIG. 18 in some respects. The fixture 650 is sized to fit within a 2 ft×2 ft ceiling opening. It is understood that other embodiments can be sized differently to fit within almost any ceiling opening. The fixture 650 comprises a light engine 652 having first and second elongated lenses 154 attached to opposite exterior surfaces of a central compartment 654. The light engine 652 spans across the middle of an opening in the ceiling and attaches to a plurality of legs 656 at each end. In this embodiment, the legs 656 taper as they extend away from the light engine 652. Similarly as with the fixture 150, a ceiling tile can be incorporated into the fixture to function as a reflector panel 658. However, this embodiment comprises two reflector panels 658 that extend from the light engine 652 on both sides out to the perimeter of the ceiling opening. The reflector panels 658 can rest on the light engine 652 and the tapered legs 656 such that reflector panels extend away from the light engine 652 at an angle. In some cases, a single ceiling tile can be cut into halves to function as the reflector panels 658. As previously noted, in other embodiments, reflector panels may be constructed from materials other than the ceiling tile, such as sheet metal or plastic, for example.

Figure 27:
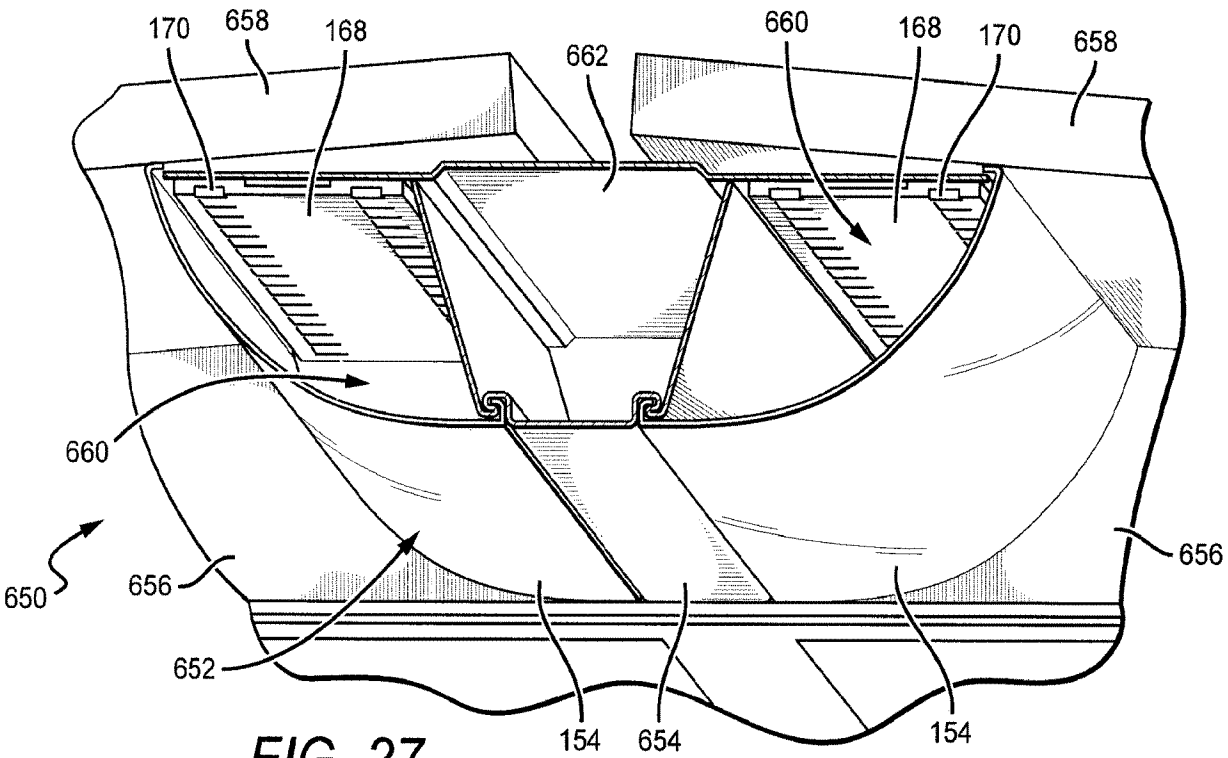
FIG. 27 is a perspective cutaway view of the light fixture according to an embodiment of the present invention.

FIG. 27 is a perspective cutaway view of the light fixture 650. The compartment 654 and the lenses 154 attach to the mount plate 662. The lenses 154 may attach to the mount plate 662 with a snap-fit structure or by other means. The fixture 650 comprises two optical cavities 660, one on each side of the central compartment 654, that are defined by the exterior walls of the compartment 654, the mount plate 662, and the lenses 154. Some embodiments may comprise end caps to cover the ends of the light engine 652 and enclose the optical cavities 660. Light strips 168 containing at least one light source 170 can be mounted to the mount plate 662 such that the light source(s) are positioned to emit at least some light into the optical cavities 660. In this embodiment, the sidewalls of the compartment meet the mount plate 662 at a non-perpendicular angle such that the compartment 654 has a trapezoidal cross-section. The sidewalls of the compartment 654 are angled to help redirect light from the sources 170 toward the lenses 154. Similarly as shown in FIG. 24, driver electronics (not shown) can be housed in the compartment 654. In other embodiments, the sidewalls can be perpendicular to the mount plate 662. The legs 656 connect to the light engine 652 and taper as they extend toward the perimeter of the ceiling opening.

FIG. 28 is a perspective view of a fixture 680 according to an embodiment of the present invention. The fixture 680 is similar to the fixture 650, except that the fixture 680 comprises longer legs 682 such that the fixture 680 is sized to fit in a 2 ft×4 ft ceiling opening. In both fixtures 650, 680 the light engine 652 is the same. Thus a single light engine 652 can be used with legs of varying size to accommodate almost any size ceiling hole.

Figure 29:
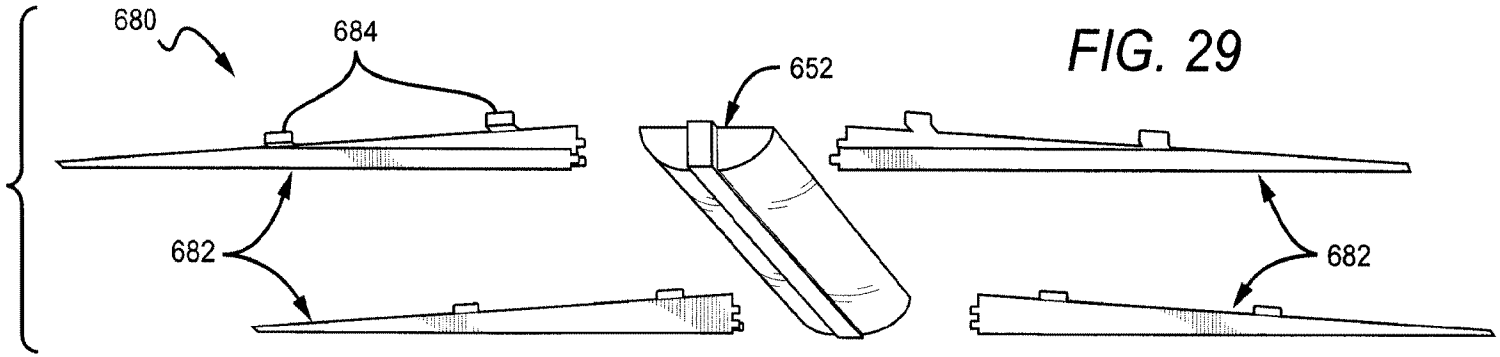
FIG. 29 is a perspective view of the fixture according to an embodiment of the present invention.

FIG. 29 is a perspective view of the fixture 680 in a disassembled state. In some embodiments, the fixture 680 can be easily assembled and disassembled without the use of tools. During installation the legs 682 are attached to the light engine 652 and then attached to an external structure, such as a T-grid for example, to support the fixture 680. The fixture 680 as well as the other fixtures disclosed herein are designed to be modular in that the light engines can connect to legs of all different lengths so that one fixture can fit in ceiling openings having various sizes. The legs 682 may comprise hooks 684 that connect to an external structure to provide additional support for the fixture 680 and to keep it from moving around in the presence of jolts or vibrations, such as an earthquake, for example.

When the fixtures 150, 180, 650, 680 are disassembled they can be arranged for compact shipping as shown in FIG. 30. This figure is a perspective view of cartons that may be used to ship embodiments of the present invention in comparison with cartons used to ship typical troffer style fixtures currently in the market. Because the fixtures 150, 180, 650, 680 are easily assembled/disassembled, these fixtures can be broken down to occupy significantly less space than a fixture that cannot be easily disassembled which is designed to accommodate the same size ceiling space. The carton 750 is sized to accommodate a typical 2 ft×4 ft troffer; the carton 752 is for a typical 2 ft×2 ft troffer. Cartons 754, 756, 758 are sized for shipping fixtures according to embodiments of the present invention. The carton 754 is designed for shipping the disassembled fixtures 650, 680. The carton 756 is sized for shipping the disassembled fixture 180. The carton 758 is for shipping the disassembled fixture 150. In some embodiments the fixture 150 can be further disassembled to fit within the carton 754. Thus, there is a significant reduction in shipping size (by volume) of the cartons required to ship the fixtures 150, 180, 650, 680 versus the cartons necessary to ship typical troffer-style fixtures. In some cases, the reduction in carton volume is more than 60%. In other cases, the reduction in carton volume is more than 75%. In still other cases, the reduction in carton size volume is greater than 90%. This results in significant savings in costs associated with materials, storage, and shipping.

It is understood that embodiments presented herein are meant to be exemplary. The different features of the invention can be arranged in many different ways and the installation of the fixtures can be accomplished using many different elements and steps. Embodiments disclosed herein make reference to several structural components that form portions of the fixtures. It is understood that these components can be used in any combination to create variations of the housing which can be used to create many different fixtures. For example, the fixtures may be designed and shaped in various ways to cover different portions of the ceiling opening, while still making use of the existing ceiling tile as a reflector panel. FIGS. 31*a-g* provide several exemplary arrangements of fixture designs according to embodiments of the present invention. Each of these figures is a bottom plan view of a fixture that incorporates a ceiling tile as a reflector panel.

Figure 31A:
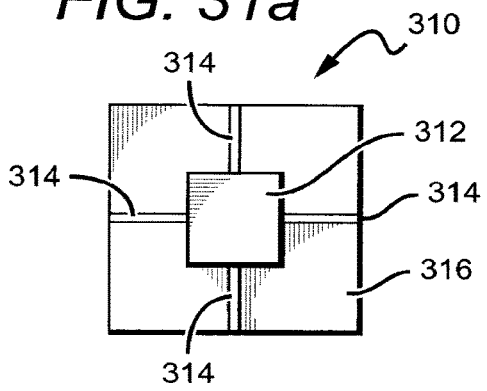
FIGS. 31*a-g* are bottom plan views of fixtures according to embodiments of the present invention.

FIG. 31*a* is a fixture 310 that comprises a central light engine 312 with four legs 314 that extend out to the edges of the ceiling opening to give the appearance of a floating shape. The ceiling tile sits atop the light engine 312 and the legs 314 and functions as a reflector panel 316.

Figure 31B:
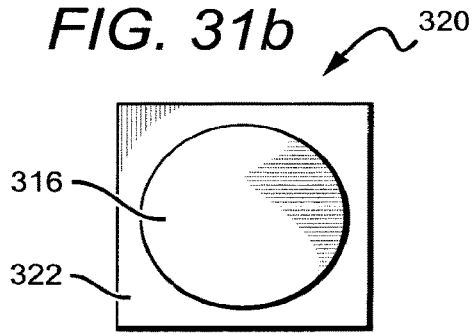

FIG. 31*b* is a fixture 320 that comprises a light engine 322 that is disposed around the perimeter of the ceiling opening. The light engine 322 comprises an exterior frame with rounded lenses. The ceiling tile sits atop the light engine 322 and functions as a reflector panel 316.

Figure 31C:
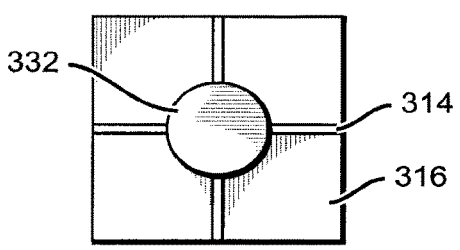

FIG. 31*c* is a fixture 330 that comprises a central circular light engine 332 with four legs 314 that extend out to the edges of the ceiling opening. The light engine lens can be flat or dome-shaped, for example. The ceiling tile sits atop the light engine 332 and the legs 314 and functions as a reflector panel 316.

Figure 31D:
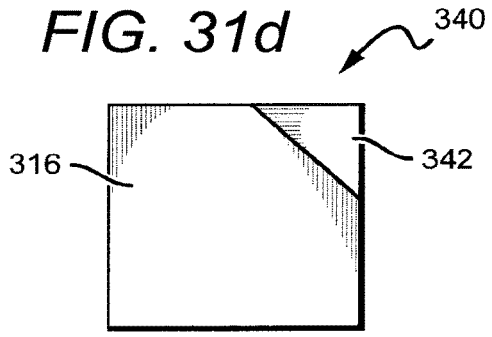

FIG. 31*d* is a fixture 340 that comprises a triangular light engine 342 disposed in one of the corners of the ceiling opening. The ceiling tile sits atop the light engine 342 and functions as a reflector panel 316.

Figure 31E:
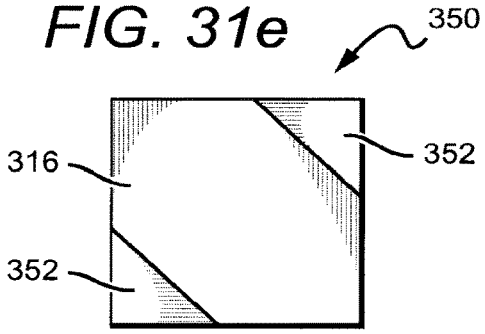

FIG. 31*e* is a fixture 350 that comprises two triangular light engines 352 disposed in opposite corners of the ceiling opening, giving the appearance of two illuminated wedges. The ceiling tile sits atop the light engines 352 and functions as a reflector panel 316.

Figure 31F:
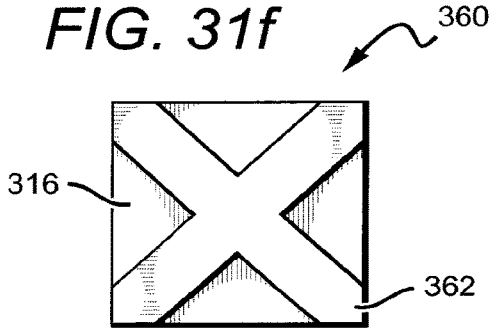

FIG. 31*f* is a fixture 360 that comprises a central X-shaped light engine 362 with illuminated bars extending out to each corner of the ceiling opening. The ceiling tile sits atop the light engine 362 and functions as a reflector panel 316.

Figure 31G:
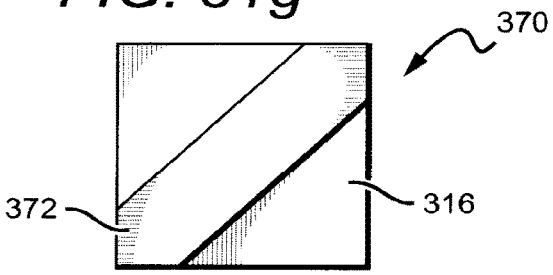

FIG. 31*g* is a fixture 370 that comprises a linear light engine 372 that spans diagonally between two opposite corners of the ceiling opening. The ceiling tile sits atop the light engine 372 and functions as a reflector panel 316.

FIG. 32 is a side cross-sectional view of a fixture 510. The fixture 510 comprises two light sticks 512 on opposite sides of the ceiling opening. Here, the light sticks 512 are resting on the horizontal lip of the T-grid. The ceiling tile sits atop the light sticks 512 and functions as a reflector panel 316.

FIG. 33*a* is a side cross-sectional view of a light fixture 520. FIG. 33*b* is a bottom plan view of the fixture 520. The fixture 520 comprises inverted trapezoidal side portions 522 around the perimeter of the ceiling opening. The chamfered edges form a truncated pyramid, mimicking the appearance of an angled troffer fixture. The ceiling tile sits atop the side portions 522 and functions as a reflector panel 316.

FIG. 34 is a side cross-sectional view of a fixture 530. The fixture 530 comprises a light engine 532 that is removably attached to a frame 534. Here, the light engine 532 drops down below the ceiling plane and emits light into the room and back into the plenum. The frame 534 rests on the horizontal lip of the T-grid and provides a surface above the ceiling plane for the ceiling tile to rest such that it functions as a reflector panel 316 for the backlight.

FIG. 35 is a side cross-sectional view of a fixture 540. The fixture 540 comprises a light bar 542 that is suspended below the ceiling plane from the T-grid with a clip frame 544 such that it emits light downward into the room. The ceiling tile sits on a top surface of the clip frame 544 and functions as a reflector panel 316.

FIG. 36 is a side cross-sectional view of a fixture 550. The fixture 550 comprises light bars 552 that are arranged around the perimeter of the ceiling opening and suspended below the ceiling plane. The light bars 552 are attached to the T-grid with clip frames 554. The ceiling tile rests on a top surface of the clip frames 554 and functions as a reflector panel 316.

FIG. 37 is a side cross-sectional view of a fixture 560. The fixture 560 comprises light bars 562 resting on the horizontal lip of the T-grid above the ceiling plane. In this embodiment, the ceiling tile is not used as the reflector panel. Instead, a different material is used. The reflector panel 564 is laid on a top surface of the light bars 562. The reflector panel 564 can be made from a flexible material that can be rolled up for shipping or storage. In some embodiments, the ceiling tile can rest on top of the reflector panel 564 to provide additional structure and to complete the enclosure for safety purposes.

FIG. 38*a* is a bottom plan view of a fixture 570 according to an embodiment of the present invention. FIG. 38*b* is a side cross-sectional view of a portion of the fixture 570. The fixture 570 comprises a plurality of light bars 572 arranged around the perimeter of the ceiling opening. The light bars 572 can be connected to the ceiling tile 574 with clamps 576. Once clamped onto the ceiling tile 574, the entire fixture 570 can rest on the horizontal lip of the T-grid with the ceiling tile 574 functioning as a reflector panel.

FIG. 39 is a side cross-sectional view of a portion of a fixture 580. The fixture 580 comprises at least one light bar 582 arranged around the perimeter of the ceiling opening. The light bar 582 is attached to a frame 584 that rests on the horizontal lip of the T-grid. The ceiling tile 586 can rest on a top surface of the frame 584. A flexible tent 588 spans across the ceiling opening below the ceiling tile 586. The tent 588 can be made of semi-rigid material or fabric such that it can maintain an arched shape without the need for suspension from the ceiling tile 586. The tent 588 can comprise a reflective material or coating such that it can function as a reflector panel or an illuminated surface. When installed, the tent 588 may be shaped such that there is a space between the tent 588 and the ceiling tile that can accommodate a driver circuit 589.

FIG. 40 is a side cross-sectional view of a fixture 590. The fixture 590 comprises a light engine 592 having a male connector 594 designed to pass through a ceiling tile 596 and mate with a female connector 598 in a junction box 599, for example, on the back side. Thus, the ceiling tile 596 is interposed between the light engine 592 and the junction box 599. The light engine 592 can be shaped in various ways, for example, square or round. The male connector 594 can be sharp enough to pierce the ceiling tile 596, or a hole can be cut in the ceiling tile 596 to allow the connector 594 to pass through. The ceiling tile 596 rests on the horizontal lip of the T-grid and functions as an illuminated surface.

FIG. 41 is a bottom plan view of a fixture 850. The fixture 850 comprises light engines 852 that are connected with collapsible legs 854. The legs 854 can fold in to provide a compact structure for shipping and storage. When assembled the legs 854 fold out and lock in place to provide structure for the fixture 850.

FIG. 42 is a side cross-sectional view of a fixture 860. The fixture 860 comprises a thin light engine 862 that slides or snaps into the T-grid structure. The ceiling tile 864 can rest on the back side surface of the light engine 862 and function as a reflector panel. Because the ceiling tile 864 and the T-grid provide a safety barrier, the light engine 862 can be made from many different materials, including materials that are not fire rated (non-5VA), so long as the light engine 862 does not protrude too far into the plenum.

FIG. 43 is a bottom plan view of a fixture 870. The fixture 870 comprises light engines 872 that are pivotally connected to legs 874 such that the fixture 870 can fold up into a compact structure for shipping and storage. When assembled, the legs 874 can connect to the light engines 872 and lock into place, finishing the structure.

FIG. 44 is a side cross-sectional view of a portion of a fixture 880. The fixture 880 comprises a decorative lens 882 that can mimic the appearance of a crown molding, for example. Here, the fixture 880 would appear similar to a coffered ceiling but with an illuminated perimeter surface.

FIG. 45 is a side cross-sectional view of a fixture 890. The fixture 890 comprises a linear light engine 892 that spans the ceiling opening through the center of the opening. The light engine 892 is supported by linear reflectors 894 on both sides that also span the ceiling opening. Reflector panels 896, for example portions of the ceiling tile, rest on the horizontal lip of the T-grid and extend out to meet the reflectors 894.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

We claim:

1. A light fixture, comprising:

two light engine units disposed on opposite sides of a ceiling opening and arranged on a perimeter of the ceiling opening such that each of the two light engine units spans an entire length of the ceiling opening; and a structure to support the two light engine units when installed, the support structure comprising two legs extending between the two light engine units, wherein the two legs are removably attached to the two light engine units;

wherein the light fixture, when assembled, is designed to fit within the ceiling opening, wherein the ceiling opening has area dimensions of at least two feet by two feet;

wherein the light fixture, when disassembled, fits within a shipping carton having a volume of 750 cubic inches or less; and wherein the two light engine units and the two legs define an open area, and a reflector panel covers the open area, the reflector panel being identical to a plurality of ceiling tiles of the ceiling.

2. The light fixture of claim 1, wherein the at least one light engine unit comprises:

one light engine unit;

tapered legs extending from the one light engine unit, wherein the tapered legs are removably attached to the one light engine unit;

a reflector panel on top of the one light engine unit and the tapered legs such that the reflector panel angles down from the one light engine unit to an opposite edge of the ceiling opening such that light distribution is asymmetrically projected to one side of the light fixture.

3. The light fixture of claim 2, wherein the tapered legs taper as they extend away from the one light engine unit.

4. The light fixture of claim 2, wherein the tapered legs support the reflector panel.

5. The light fixture of claim 1, wherein the at least one light engine unit includes an elongated lens that is removably attached to an elongated compartment.

6. The light fixture of claim 5, wherein the elongated lens and the elongated compartment are attached to a mount plate, wherein the elongated lens, the elongated compartment and the mount plate define an optical cavity, a light strip comprising a plurality of LEDs is mounted to the mount plate such that the plurality of LEDs are positioned to emit at least some light into the optical cavity and through the elongated lens.

7. The light fixture of claim 1, wherein the light fixture, when disassembled, fits within a shipping carton having a volume of 500 cubic inches or less.

8. The light fixture of claim 1, wherein the light fixture, when disassembled, fits within a shipping carton having a volume of 450 cubic inches or less.

9. The light fixture of claim 1, wherein electrical wiring extends through at least one of the two legs to deliver power to at least one of the two light engine units, and further comprising a connector between the electrical wiring and the at least one of the two light engine units.

10. The light fixture of claim 1, wherein the at least one light engine unit is disposed in a center portion of the ceiling opening, the at least one light engine unit comprising a first elongated lens and a second elongated lens attached to opposite sides of a central compartment and at least partially defining two optical cavities, one of the two optical cavities being on each side of the at least one light engine unit;

at least one light source positioned to emit at least some light into the two optical cavities such that the two optical cavities emit light to opposite sides of the at least one light unit.

11. A modular light fixture, comprising:

at least one light engine;

a plurality of tapered legs detachably connected to the at least one light engine, the legs extending from the at least one light engine to attach the at least one light engine to an external structure; and a reflector panel on top of the at least one light engine and the tapered legs such that the reflector panel angles down from the at least one light engine to an opposite edge of the ceiling opening such that light distribution is asymmetrically projected to one side of the light fixture;

wherein a length of the legs is selected such that the modular light fixture fits within the ceiling opening.

12. The modular light fixture of claim 11, wherein the plurality of legs are selected such that the modular light fixture fits within a square opening measuring two feet by two feet.

13. The modular light fixture of claim 11, wherein the plurality of legs are selected such that the modular light fixture fits within a rectangular opening measuring two feet by four feet.

14. The light fixture of claim 11, wherein the tapered legs taper as they extend away from the one light engine unit.

15. A light fixture, comprising:

at least one light engine unit;

tapered legs extending from the one light engine unit, wherein the tapered legs are removably attached to the one light engine unit to support the at least one light engine unit when installed; and a reflector panel on top of the one light engine unit and the tapered legs such that the reflector panel angles down from the one light engine unit to an opposite edge of a ceiling opening such that light distribution is asymmetrically projected to one side of the light fixture;

wherein the light fixture, when assembled, is designed to fit within the ceiling having area dimensions of at least two feet by two feet; and wherein the light fixture, when disassembled, fits within a shipping carton having a volume of 750 cubic inches or less.

16. The light fixture of claim 15, wherein the tapered legs taper as they extend away from the one light engine unit.

* * * * *